US010154352B2

(12) United States Patent
Perkins et al.

(10) Patent No.: US 10,154,352 B2
(45) Date of Patent: Dec. 11, 2018

(54) MULTIFUNCTION SYSTEM AND METHOD FOR INTEGRATED HEARING AND COMMUNICATION WITH NOISE CANCELLATION AND FEEDBACK MANAGEMENT

(71) Applicant: EarLens Corporation, Menlo Park, CA (US)

(72) Inventors: Rodney C. Perkins, Woodside, CA (US); Sunil Puria, Boston, MA (US); Jonathan P. Fay, Dexter, MI (US)

(73) Assignee: EarLens Corporation, Menlo Park, CA (US)

( * ) Notice: Subject to any disclaimer, the term of this patent is extended or adjusted under 35 U.S.C. 154(b) by 0 days.

(21) Appl. No.: 15/804,995

(22) Filed: Nov. 6, 2017

(65) Prior Publication Data

US 2018/0063652 A1 Mar. 1, 2018

Related U.S. Application Data

(60) Continuation of application No. 14/949,495, filed on Nov. 23, 2015, which is a continuation of application (Continued)

(51) Int. Cl.

| | |
|---|---|
| ***H04R 25/00*** | (2006.01) |
| ***H04R 1/26*** | (2006.01) |
| ***H04R 29/00*** | (2006.01) |

(52) U.S. Cl.

CPC ..... *H04R 25/453* (2013.01); *H04R 1/265* (2013.01); *H04R 25/405* (2013.01);

(Continued)

(58) Field of Classification Search

CPC ..... H04R 25/02; H04R 25/40; H04R 25/402; H04R 25/405; H04R 25/407; H04R 25/43;

(Continued)

(56) References Cited

U.S. PATENT DOCUMENTS 2,763,334 A 9/1956 Starkey
3,209,082 A 9/1965 McCarrell et al.

(Continued)

FOREIGN PATENT DOCUMENTS

AU 2004301961 A1 2/2005
DE 2044870 A1 3/1972

(Continued)

OTHER PUBLICATIONS

Co-pending U.S. Appl. No. 15/706,181, filed Sep. 15, 2017.

(Continued)

*Primary Examiner* — Joshua Kaufman

(74) *Attorney, Agent, or Firm* — Wilson Sonsini Goodrich and Rosati, P.C.

(57) ABSTRACT

Systems, devices and methods for communication include an ear canal microphone configured for placement in the ear canal to detect high frequency sound localization cues. An external microphone positioned away from the ear canal can detect low frequency sound, such that feedback can be substantially reduced. The canal microphone and the external microphone are coupled to a transducer, such that the user perceives sound from the external microphone and the canal microphone with high frequency localization cues and decreased feedback. Wireless circuitry can be configured to connect to many devices with a wireless protocol, such that the user can receive and transmit audio signals. A bone conduction sensor can detect near-end speech of the user for transmission with the wireless circuitry in a noisy environment. Noise cancellation of background sounds near the user can be provided.

9 Claims, 12 Drawing Sheets

Related U.S. Application Data

No. 13/768,825, filed on Feb. 15, 2013, now Pat. No. 9,226,083, which is a division of application No. 12/251,200, filed on Oct. 14, 2008, now Pat. No. 8,401,212.

(60) Provisional application No. 60/979,645, filed on Oct. 12, 2007.

(52) U.S. Cl.
CPC ..... *H04R 25/407* (2013.01); *H04R 25/43* (2013.01); *H04R 25/606* (2013.01); *H04R 29/00* (2013.01); *H04R 25/554* (2013.01); *H04R 2225/43* (2013.01); *H04R 2460/01* (2013.01); *H04R 2460/13* (2013.01)

(58) Field of Classification Search
CPC .... H04R 25/50; H04R 25/502; H04R 25/505; H04R 25/55; H04R 25/554; H04R 25/604; H04R 25/606; H04R 25/608; H04R 25/453; H04R 1/265; H04R 2225/43; H04R 2460/01; H04R 2460/13
See application file for complete search history.

(56) References Cited

U.S. PATENT DOCUMENTS 3,229,049 A 1/1966 Goldberg
3,440,314 A 4/1969 Eldon
3,526,949 A 9/1970 Genovese
3,549,818 A 12/1970 Justin
3,585,416 A 6/1971 Mellen
3,594,514 A 7/1971 Wingrove
3,710,399 A 1/1973 Hurst
3,712,962 A 1/1973 Epley
3,764,748 A 10/1973 Branch et al.
3,808,179 A 4/1974 Gaylord
3,882,285 A 5/1975 Nunley et al.
3,965,430 A 6/1976 Brandt
3,985,977 A 10/1976 Beaty et al.
4,002,897 A 1/1977 Kleinman et al.
4,031,318 A 6/1977 Pitre
4,061,972 A 12/1977 Burgess
4,075,042 A 2/1978 Das
4,098,277 A 7/1978 Mendell
4,109,116 A 8/1978 Victoreen
4,120,570 A 10/1978 Gaylord
4,248,899 A 2/1981 Lyon et al.
4,252,440 A 2/1981 Frosch et al.
4,303,772 A 12/1981 Novicky
4,319,359 A 3/1982 Wolf
4,334,315 A 6/1982 Ono et al.
4,334,321 A 6/1982 Edelman
4,338,929 A 7/1982 Lundin et al.
4,339,954 A 7/1982 Anson et al.
4,357,497 A 11/1982 Hochmair et al.
4,380,689 A 4/1983 Giannetti
4,428,377 A 1/1984 Zollner et al.
4,524,294 A 6/1985 Brody
4,540,761 A 9/1985 Kawamura et al.
4,556,122 A 12/1985 Goode
4,592,087 A 5/1986 Killion
4,606,329 A 8/1986 Hough
4,611,598 A 9/1986 Hortmann et al.
4,628,907 A 12/1986 Epley
4,641,377 A 2/1987 Rush et al.
4,652,414 A 3/1987 Schlaegel
4,654,554 A 3/1987 Kishi
4,689,819 A 8/1987 Killion et al.
4,696,287 A 9/1987 Hortmann et al.
4,729,366 A 3/1988 Schaefer
4,741,339 A 5/1988 Harrison et al.
4,742,499 A 5/1988 Butler
4,756,312 A 7/1988 Epley
4,759,070 A 7/1988 Voroba et al.
4,766,607 A 8/1988 Feldman
4,774,933 A 10/1988 Hough et al.
4,776,322 A 10/1988 Hough et al.
4,782,818 A 11/1988 Mori
4,800,884 A 1/1989 Heide et al.
4,800,982 A 1/1989 Carlson
4,817,607 A 4/1989 Tatge
4,840,178 A 6/1989 Heide et al.
4,845,755 A 7/1989 Busch et al.
4,865,035 A 9/1989 Mori
4,870,688 A 9/1989 Voroba et al.
4,932,405 A 6/1990 Peeters et al.
4,936,305 A 6/1990 Ashtiani et al.
4,944,301 A 7/1990 Widin et al.
4,948,855 A 8/1990 Novicky
4,957,478 A 9/1990 Maniglia
4,963,963 A 10/1990 Dorman
4,999,819 A 3/1991 Newnham et al.
5,003,608 A 3/1991 Carlson
5,012,520 A 4/1991 Steeger
5,015,224 A 5/1991 Maniglia
5,015,225 A 5/1991 Hough et al.
5,031,219 A 7/1991 Ward et al.
5,061,282 A 10/1991 Jacobs
5,066,091 A 11/1991 Stoy et al.
5,068,902 A 11/1991 Ward
5,094,108 A 3/1992 Kim et al.
5,117,461 A 5/1992 Moseley
5,142,186 A 8/1992 Cross et al.
5,163,957 A 11/1992 Sade et al.
5,167,235 A 12/1992 Seacord et al.
5,201,007 A 4/1993 Ward et al.
5,259,032 A 11/1993 Perkins et al.
5,272,757 A 12/1993 Scofield et al.
5,276,910 A 1/1994 Buchele
5,277,694 A 1/1994 Leysieffer et al.
5,282,858 A 2/1994 Bisch et al.
5,360,388 A 11/1994 Spindel et al.
5,378,933 A 1/1995 Pfannenmueller et al.
5,402,496 A 3/1995 Soli et al.
5,411,467 A 5/1995 Hortmann et al.
5,425,104 A 6/1995 Shennib
5,440,082 A 8/1995 Claes
5,440,237 A 8/1995 Brown et al.
5,455,994 A 10/1995 Termeer et al.
5,456,654 A 10/1995 Ball
5,531,787 A 7/1996 Lesinski et al.
5,531,954 A 7/1996 Heide et al.
5,535,282 A 7/1996 Luca
5,554,096 A 9/1996 Ball
5,558,618 A 9/1996 Maniglia
5,572,594 A 11/1996 Devoe et al.
5,606,621 A 2/1997 Reiter et al.
5,624,376 A 4/1997 Ball et al.
5,654,530 A 8/1997 Sauer et al.
5,692,059 A 11/1997 Kruger
5,699,809 A 12/1997 Combs et al.
5,701,348 A 12/1997 Shennib et al.
5,707,338 A 1/1998 Adams et al.
5,715,321 A 2/1998 Andrea et al.
5,721,783 A 2/1998 Anderson
5,722,411 A 3/1998 Suzuki et al.
5,729,077 A 3/1998 Newnham et al.
5,740,258 A 4/1998 Goodwin-Johansson
5,749,912 A 5/1998 Zhang et al.
5,762,583 A 6/1998 Adams et al.
5,772,575 A 6/1998 Lesinski et al.
5,774,259 A 6/1998 Saitoh et al.
5,782,744 A 7/1998 Money
5,788,711 A 8/1998 Lehner et al.
5,795,287 A 8/1998 Ball et al.
5,797,834 A 8/1998 Goode
5,800,336 A 9/1998 Ball et al.
5,804,109 A 9/1998 Perkins
5,804,907 A 9/1998 Park et al.
5,814,095 A 9/1998 Mueller et al.
5,825,122 A 10/1998 Givargizov et al.
5,836,863 A 11/1998 Bushek et al.

(56) References Cited

U.S. PATENT DOCUMENTS

| | | | |
|---|---|---|---|
| 5,842,967 | A | 12/1998 | Kroll |
| 5,857,958 | A | 1/1999 | Ball et al. |
| 5,859,916 | A | 1/1999 | Ball et al. |
| 5,868,682 | A | 2/1999 | Combs et al. |
| 5,879,283 | A | 3/1999 | Adams et al. |
| 5,888,187 | A | 3/1999 | Jaeger et al. |
| 5,897,486 | A | 4/1999 | Ball et al. |
| 5,899,847 | A | 5/1999 | Adams et al. |
| 5,900,274 | A | 5/1999 | Chatterjee et al. |
| 5,906,635 | A | 5/1999 | Maniglia |
| 5,913,815 | A | 6/1999 | Ball et al. |
| 5,922,077 | A | 7/1999 | Espy et al. |
| 5,940,519 | A | 8/1999 | Kuo |
| 5,949,895 | A | 9/1999 | Ball et al. |
| 5,984,859 | A | 11/1999 | Lesinski |
| 5,987,146 | A | 11/1999 | Pluvinage et al. |
| 6,005,955 | A | 12/1999 | Kroll et al. |
| 6,011,984 | A | 1/2000 | Van Antwerp et al. |
| 6,024,717 | A | 2/2000 | Ball et al. |
| 6,045,528 | A | 4/2000 | Arenberg et al. |
| 6,050,933 | A | 4/2000 | Bushek et al. |
| 6,068,589 | A | 5/2000 | Neukermans |
| 6,068,590 | A | 5/2000 | Brisken |
| 6,084,975 | A | 7/2000 | Perkins |
| 6,093,144 | A | 7/2000 | Jaeger et al. |
| 6,135,612 | A | 10/2000 | Clore |
| 6,137,889 | A | 10/2000 | Shennib et al. |
| 6,139,488 | A | 10/2000 | Ball |
| 6,153,966 | A | 11/2000 | Neukermans |
| 6,168,948 | B1 | 1/2001 | Anderson et al. |
| 6,174,278 | B1 | 1/2001 | Jaeger et al. |
| 6,181,801 | B1 | 1/2001 | Puthuff et al. |
| 6,190,305 | B1 | 2/2001 | Ball et al. |
| 6,190,306 | B1 | 2/2001 | Kennedy |
| 6,208,445 | B1 | 3/2001 | Reime |
| 6,217,508 | B1 | 4/2001 | Ball et al. |
| 6,222,302 | B1 | 4/2001 | Imada et al. |
| 6,222,927 | B1 | 4/2001 | Feng et al. |
| 6,240,192 | B1 | 5/2001 | Brennan et al. |
| 6,241,767 | B1 | 6/2001 | Stennert et al. |
| 6,259,951 | B1 | 7/2001 | Kuzma et al. |
| 6,261,224 | B1 | 7/2001 | Adams et al. |
| 6,264,603 | B1 | 7/2001 | Kennedy |
| 6,277,148 | B1 | 8/2001 | Dormer |
| 6,312,959 | B1 | 11/2001 | Datskos |
| 6,339,648 | B1 | 1/2002 | McIntosh et al. |
| 6,354,990 | B1 | 3/2002 | Juneau et al. |
| 6,359,993 | B2 | 3/2002 | Brimhall |
| 6,366,863 | B1 | 4/2002 | Bye et al. |
| 6,385,363 | B1 | 5/2002 | Rajic et al. |
| 6,387,039 | B1 | 5/2002 | Moses |
| 6,393,130 | B1 | 5/2002 | Stonikas et al. |
| 6,422,991 | B1 | 7/2002 | Jaeger |
| 6,432,248 | B1 | 8/2002 | Popp et al. |
| 6,436,028 | B1 | 8/2002 | Dormer |
| 6,438,244 | B1 | 8/2002 | Juneau et al. |
| 6,445,799 | B1 | 9/2002 | Taenzer et al. |
| 6,473,512 | B1 | 10/2002 | Juneau et al. |
| 6,475,134 | B1 | 11/2002 | Ball et al. |
| 6,491,644 | B1 | 12/2002 | Vujanic et al. |
| 6,493,453 | B1 | 12/2002 | Glendon |
| 6,493,454 | B1 | 12/2002 | Loi et al. |
| 6,498,858 | B2 | 12/2002 | Kates |
| 6,519,376 | B2 | 2/2003 | Biagi et al. |
| 6,523,985 | B2 | 2/2003 | Hamanaka et al. |
| 6,536,530 | B2 | 3/2003 | Schultz et al. |
| 6,537,200 | B2 | 3/2003 | Leysieffer et al. |
| 6,549,633 | B1 | 4/2003 | Westermann |
| 6,549,635 | B1 | 4/2003 | Gebert |
| 6,554,761 | B1 | 4/2003 | Puria et al. |
| 6,575,894 | B2 | 6/2003 | Leysieffer et al. |
| 6,592,513 | B1 | 7/2003 | Kroll et al. |
| 6,603,860 | B1 | 8/2003 | Taenzer et al. |
| 6,620,110 | B2 | 9/2003 | Schmid |
| 6,626,822 | B1 | 9/2003 | Jaeger et al. |
| 6,629,922 | B1 | 10/2003 | Puria et al. |
| 6,631,196 | B1 | 10/2003 | Taenzer et al. |
| 6,663,575 | B2 | 12/2003 | Leysieffer |
| 6,668,062 | B1 | 12/2003 | Luo et al. |
| 6,676,592 | B2 | 1/2004 | Ball et al. |
| 6,681,022 | B1 | 1/2004 | Puthuff et al. |
| 6,695,943 | B2 | 2/2004 | Juneau et al. |
| 6,697,674 | B2 | 2/2004 | Leysieffer |
| 6,724,902 | B1 | 4/2004 | Shennib et al. |
| 6,726,618 | B2 | 4/2004 | Miller |
| 6,726,718 | B1 | 4/2004 | Carlyle et al. |
| 6,727,789 | B2 | 4/2004 | Tibbetts et al. |
| 6,728,024 | B2 | 4/2004 | Ribak |
| 6,735,318 | B2 | 5/2004 | Cho |
| 6,754,358 | B1 | 6/2004 | Boesen et al. |
| 6,754,359 | B1 | 6/2004 | Svean et al. |
| 6,754,537 | B1 | 6/2004 | Harrison et al. |
| 6,785,394 | B1 | 8/2004 | Olsen et al. |
| 6,801,629 | B2 | 10/2004 | Brimhall et al. |
| 6,829,363 | B2 | 12/2004 | Sacha |
| 6,837,857 | B2 | 1/2005 | Stirnemann |
| 6,842,647 | B1 | 1/2005 | Griffith et al. |
| 6,888,949 | B1 | 5/2005 | Vanden Berghe et al. |
| 6,900,926 | B2 | 5/2005 | Ribak |
| 6,912,289 | B2 | 6/2005 | Vonlanthen et al. |
| 6,920,340 | B2 | 7/2005 | Laderman |
| 6,931,231 | B1 | 8/2005 | Griffin |
| 6,940,988 | B1 | 9/2005 | Shennib et al. |
| 6,940,989 | B1 | 9/2005 | Shennib et al. |
| D512,979 | S | 12/2005 | Corcoran et al. |
| 6,975,402 | B2 | 12/2005 | Bisson et al. |
| 6,978,159 | B2 | 12/2005 | Feng et al. |
| 7,043,037 | B2 | 5/2006 | Lichtblau et al. |
| 7,050,675 | B2 | 5/2006 | Zhou et al. |
| 7,050,876 | B1 | 5/2006 | Fu et al. |
| 7,057,256 | B2 | 6/2006 | Mazur et al. |
| 7,058,182 | B2 | 6/2006 | Kates |
| 7,072,475 | B1 | 7/2006 | Denap et al. |
| 7,076,076 | B2 | 7/2006 | Bauman |
| 7,095,981 | B1 | 8/2006 | Voroba et al. |
| 7,167,572 | B1 | 1/2007 | Harrison et al. |
| 7,174,026 | B2 | 2/2007 | Niederdrank et al. |
| 7,203,331 | B2 | 4/2007 | Boesen |
| 7,239,069 | B2 | 7/2007 | Cho |
| 7,245,732 | B2 | 7/2007 | Jorgensen et al. |
| 7,255,457 | B2 | 8/2007 | Ducharme et al. |
| 7,266,208 | B2 | 9/2007 | Charvin et al. |
| 7,289,639 | B2 | 10/2007 | Abel et al. |
| 7,313,245 | B1 | 12/2007 | Shennib |
| 7,322,930 | B2 | 1/2008 | Jaeger et al. |
| 7,349,741 | B2 | 3/2008 | Maltan et al. |
| 7,354,792 | B2 | 4/2008 | Mazur et al. |
| 7,376,563 | B2 | 5/2008 | Leysieffer et al. |
| 7,390,689 | B2 | 6/2008 | Mazur et al. |
| 7,394,909 | B1 | 7/2008 | Widmer et al. |
| 7,421,087 | B2 | 9/2008 | Perkins et al. |
| 7,424,122 | B2 | 9/2008 | Ryan |
| 7,444,877 | B2 | 11/2008 | Li et al. |
| 7,547,275 | B2 | 6/2009 | Cho et al. |
| 7,630,646 | B2 | 12/2009 | Anderson et al. |
| 7,668,325 | B2 | 2/2010 | Puria et al. |
| 7,747,295 | B2 | 6/2010 | Choi |
| 7,826,632 | B2 | 11/2010 | Von Buol et al. |
| 7,853,033 | B2 | 12/2010 | Maltan et al. |
| 7,867,160 | B2 | 1/2011 | Pluvinage et al. |
| 7,983,435 | B2 | 7/2011 | Moses |
| 8,090,134 | B2 | 1/2012 | Takigawa et al. |
| 8,128,551 | B2 | 3/2012 | Jolly |
| 8,157,730 | B2 | 4/2012 | Leboeuf et al. |
| 8,197,461 | B1 | 6/2012 | Arenberg et al. |
| 8,204,786 | B2 | 6/2012 | Leboeuf et al. |
| 8,233,651 | B1 | 7/2012 | Haller |
| 8,251,903 | B2 | 8/2012 | Leboeuf et al. |
| 8,295,505 | B2 | 10/2012 | Weinans et al. |
| 8,295,523 | B2 | 10/2012 | Fay et al. |
| 8,320,601 | B2 | 11/2012 | Takigawa et al. |
| 8,320,982 | B2 | 11/2012 | Leboeuf et al. |
| 8,340,335 | B1 | 12/2012 | Shennib |
| 8,391,527 | B2 | 3/2013 | Feucht et al. |

(56) References Cited

U.S. PATENT DOCUMENTS

| | | | |
|---|---|---|---|
| 8,396,239 | B2 | 3/2013 | Fay et al. |
| 8,401,212 | B2 | 3/2013 | Puria et al. |
| 8,506,473 | B2 | 8/2013 | Puria |
| 8,512,242 | B2 | 8/2013 | Leboeuf et al. |
| 8,526,651 | B2 | 9/2013 | Van et al. |
| 8,545,383 | B2 | 10/2013 | Wenzel et al. |
| 8,600,089 | B2 | 12/2013 | Wenzel et al. |
| 8,647,270 | B2 | 2/2014 | Leboeuf et al. |
| 8,652,040 | B2 | 2/2014 | Leboeuf et al. |
| 8,684,922 | B2 | 4/2014 | Tran |
| 8,696,054 | B2 | 4/2014 | Crum |
| 8,696,541 | B2 | 4/2014 | Pluvinage et al. |
| 8,700,111 | B2 | 4/2014 | Leboeuf et al. |
| 8,702,607 | B2 | 4/2014 | Leboeuf et al. |
| 8,715,152 | B2 | 5/2014 | Puria et al. |
| 8,715,153 | B2 | 5/2014 | Puria et al. |
| 8,715,154 | B2 | 5/2014 | Perkins et al. |
| 8,761,423 | B2 | 6/2014 | Wagner et al. |
| 8,788,002 | B2 | 7/2014 | Leboeuf et al. |
| 8,824,715 | B2 | 9/2014 | Fay et al. |
| 8,855,323 | B2 | 10/2014 | Kroman |
| 8,858,419 | B2 | 10/2014 | Puria et al. |
| 8,885,860 | B2 | 11/2014 | Djalilian et al. |
| 8,886,269 | B2 | 11/2014 | Leboeuf et al. |
| 8,888,701 | B2 | 11/2014 | Leboeuf et al. |
| 8,923,941 | B2 | 12/2014 | Leboeuf et al. |
| 8,929,965 | B2 | 1/2015 | Leboeuf et al. |
| 8,929,966 | B2 | 1/2015 | Leboeuf et al. |
| 8,934,952 | B2 | 1/2015 | Leboeuf et al. |
| 8,942,776 | B2 | 1/2015 | Leboeuf et al. |
| 8,961,415 | B2 | 2/2015 | Leboeuf et al. |
| 8,989,830 | B2 | 3/2015 | Leboeuf et al. |
| 9,044,180 | B2 | 6/2015 | Leboeuf et al. |
| 9,049,528 | B2 | 6/2015 | Fay et al. |
| 9,131,312 | B2 | 9/2015 | Leboeuf et al. |
| 9,154,891 | B2 | 10/2015 | Puria et al. |
| 9,211,069 | B2 | 12/2015 | Larsen et al. |
| 9,226,083 | B2 | 12/2015 | Puria et al. |
| 9,289,135 | B2 | 3/2016 | Leboeuf et al. |
| 9,289,175 | B2 | 3/2016 | Leboeuf et al. |
| 9,301,696 | B2 | 4/2016 | Leboeuf et al. |
| 9,314,167 | B2 | 4/2016 | Leboeuf et al. |
| 9,392,377 | B2 | 7/2016 | Olsen et al. |
| 9,427,191 | B2 | 8/2016 | Leboeuf et al. |
| 9,521,962 | B2 | 12/2016 | Leboeuf |
| 9,538,921 | B2 | 1/2017 | Leboeuf et al. |
| 9,544,700 | B2 | 1/2017 | Puria et al. |
| 9,591,409 | B2 | 3/2017 | Puria et al. |
| 9,749,758 | B2 | 8/2017 | Puria et al. |
| 9,750,462 | B2 | 9/2017 | Leboeuf et al. |
| 9,788,785 | B2 | 10/2017 | Leboeuf |
| 9,788,794 | B2 | 10/2017 | Leboeuf et al. |
| 9,794,653 | B2 | 10/2017 | Aumer et al. |
| 9,801,552 | B2 | 10/2017 | Romesburg et al. |
| 9,808,204 | B2 | 11/2017 | Leboeuf et al. |
| 9,949,045 | B2 | 4/2018 | Kure et al. |
| 2001/0003788 | A1 | 6/2001 | Ball et al. |
| 2001/0007050 | A1 | 7/2001 | Adelman |
| 2001/0024507 | A1 | 9/2001 | Boesen |
| 2001/0027342 | A1 | 10/2001 | Dormer |
| 2001/0043708 | A1 | 11/2001 | Brimhall |
| 2001/0053871 | A1 | 12/2001 | Zilberman et al. |
| 2002/0012438 | A1 | 1/2002 | Leysieffer et al. |
| 2002/0029070 | A1 | 3/2002 | Leysieffer et al. |
| 2002/0030871 | A1 | 3/2002 | Anderson et al. |
| 2002/0035309 | A1 | 3/2002 | Leysieffer |
| 2002/0085728 | A1 | 7/2002 | Shennib et al. |
| 2002/0086715 | A1 | 7/2002 | Sahagen |
| 2002/0172350 | A1 | 11/2002 | Edwards et al. |
| 2002/0183587 | A1 | 12/2002 | Dormer |
| 2003/0021903 | A1 | 1/2003 | Shlenker et al. |
| 2003/0064746 | A1 | 4/2003 | Rader et al. |
| 2003/0081803 | A1 | 5/2003 | Petilli et al. |
| 2003/0097178 | A1 | 5/2003 | Roberson et al. |
| 2003/0125602 | A1 | 7/2003 | Sokolich et al. |
| 2003/0142841 | A1 | 7/2003 | Wiegand |
| 2003/0208099 | A1 | 11/2003 | Ball |
| 2003/0208888 | A1 | 11/2003 | Fearing et al. |
| 2004/0019294 | A1 | 1/2004 | Stirnemann |
| 2004/0121291 | A1 | 6/2004 | Knapp et al. |
| 2004/0165742 | A1 | 8/2004 | Shennib et al. |
| 2004/0166495 | A1 | 8/2004 | Greinwald et al. |
| 2004/0167377 | A1 | 8/2004 | Schafer et al. |
| 2004/0184732 | A1 | 9/2004 | Zhou et al. |
| 2004/0202339 | A1 | 10/2004 | O'Brien et al. |
| 2004/0202340 | A1 | 10/2004 | Armstrong et al. |
| 2004/0208333 | A1 | 10/2004 | Cheung et al. |
| 2004/0234089 | A1 | 11/2004 | Rembrand et al. |
| 2004/0234092 | A1 | 11/2004 | Wada et al. |
| 2004/0236416 | A1 | 11/2004 | Falotico |
| 2004/0240691 | A1 | 12/2004 | Grafenberg |
| 2005/0018859 | A1 | 1/2005 | Buchholz |
| 2005/0020873 | A1 | 1/2005 | Berrang et al. |
| 2005/0036639 | A1 | 2/2005 | Bachler et al. |
| 2005/0038498 | A1 | 2/2005 | Dubrow et al. |
| 2005/0088435 | A1 | 4/2005 | Geng |
| 2005/0101830 | A1 | 5/2005 | Easter et al. |
| 2005/0163333 | A1 | 7/2005 | Abel et al. |
| 2005/0226446 | A1 | 10/2005 | Luo et al. |
| 2005/0271870 | A1 | 12/2005 | Jackson |
| 2006/0015155 | A1 | 1/2006 | Charvin et al. |
| 2006/0023908 | A1 | 2/2006 | Perkins et al. |
| 2006/0058573 | A1 | 3/2006 | Neisz et al. |
| 2006/0062420 | A1 | 3/2006 | Araki |
| 2006/0074159 | A1 | 4/2006 | Lu et al. |
| 2006/0075175 | A1 | 4/2006 | Jensen et al. |
| 2006/0107744 | A1 | 5/2006 | Li et al. |
| 2006/0161255 | A1 | 7/2006 | Zarowski et al. |
| 2006/0177079 | A1 | 8/2006 | Baekgaard et al. |
| 2006/0177082 | A1 | 8/2006 | Solomito, Jr. et al. |
| 2006/0183965 | A1 | 8/2006 | Kasic et al. |
| 2006/0189841 | A1 | 8/2006 | Pluvinage et al. |
| 2006/0231914 | A1 | 10/2006 | Carey |
| 2006/0233398 | A1 | 10/2006 | Husung |
| 2006/0237126 | A1 | 10/2006 | Guffrey et al. |
| 2006/0247735 | A1 | 11/2006 | Honert et al. |
| 2006/0251278 | A1 | 11/2006 | Puria et al. |
| 2006/0256989 | A1 | 11/2006 | Olsen et al. |
| 2006/0278245 | A1 | 12/2006 | Gan |
| 2007/0030990 | A1 | 2/2007 | Fischer |
| 2007/0036377 | A1 | 2/2007 | Stirnemann |
| 2007/0076913 | A1 | 4/2007 | Schanz |
| 2007/0083078 | A1 | 4/2007 | Easter et al. |
| 2007/0100197 | A1 | 5/2007 | Perkins et al. |
| 2007/0127748 | A1 | 6/2007 | Carlile et al. |
| 2007/0127752 | A1 | 6/2007 | Armstrong |
| 2007/0127766 | A1 | 6/2007 | Combest |
| 2007/0135870 | A1 | 6/2007 | Shanks et al. |
| 2007/0161848 | A1 | 7/2007 | Dalton et al. |
| 2007/0191673 | A1 | 8/2007 | Ball et al. |
| 2007/0206825 | A1 | 9/2007 | Thomasson |
| 2007/0225776 | A1 | 9/2007 | Fritsch et al. |
| 2007/0236704 | A1 | 10/2007 | Carr et al. |
| 2007/0250119 | A1 | 10/2007 | Tyler et al. |
| 2007/0251082 | A1 | 11/2007 | Milojevic et al. |
| 2007/0286429 | A1 | 12/2007 | Grafenberg et al. |
| 2008/0021518 | A1 | 1/2008 | Hochmair et al. |
| 2008/0051623 | A1 | 2/2008 | Schneider et al. |
| 2008/0054509 | A1 | 3/2008 | Berman et al. |
| 2008/0063228 | A1 | 3/2008 | Mejia et al. |
| 2008/0063231 | A1 | 3/2008 | Juneau et al. |
| 2008/0064918 | A1 | 3/2008 | Jolly |
| 2008/0089292 | A1 | 4/2008 | Kitazoe et al. |
| 2008/0107292 | A1 | 5/2008 | Kornagel |
| 2008/0123866 | A1 | 5/2008 | Rule et al. |
| 2008/0188707 | A1 | 8/2008 | Bernard et al. |
| 2008/0298600 | A1 | 12/2008 | Poe et al. |
| 2008/0300703 | A1 | 12/2008 | Widmer et al. |
| 2009/0023976 | A1 | 1/2009 | Cho et al. |
| 2009/0043149 | A1 | 2/2009 | Abel et al. |
| 2009/0076581 | A1 | 3/2009 | Gibson |
| 2009/0092271 | A1 | 4/2009 | Fay et al. |
| 2009/0097681 | A1 | 4/2009 | Puria et al. |
| 2009/0141919 | A1 | 6/2009 | Spitaels et al. |

(56) References Cited

U.S. PATENT DOCUMENTS

| | | | |
|---|---|---|---|
| 2009/0149697 | A1 | 6/2009 | Steinhardt et al. |
| 2009/0253951 | A1 | 10/2009 | Ball et al. |
| 2009/0262966 | A1 | 10/2009 | Vestergaard et al. |
| 2009/0281367 | A1 | 11/2009 | Cho et al. |
| 2009/0310805 | A1 | 12/2009 | Petroff |
| 2010/0034409 | A1 | 2/2010 | Fay et al. |
| 2010/0036488 | A1 | 2/2010 | de Juan, Jr. et al. |
| 2010/0048982 | A1 | 2/2010 | Puria et al. |
| 2010/0085176 | A1 | 4/2010 | Flick |
| 2010/0111315 | A1 | 5/2010 | Kroman |
| 2010/0152527 | A1 | 6/2010 | Puria |
| 2010/0177918 | A1 | 7/2010 | Keady et al. |
| 2010/0202645 | A1 | 8/2010 | Puria et al. |
| 2010/0222639 | A1 | 9/2010 | Purcell et al. |
| 2010/0272299 | A1 | 10/2010 | Van Schuylenbergh et al. |
| 2010/0290653 | A1 | 11/2010 | Wiggins et al. |
| 2010/0312040 | A1 | 12/2010 | Puria et al. |
| 2011/0069852 | A1 | 3/2011 | Arndt et al. |
| 2011/0077453 | A1 | 3/2011 | Pluvinage et al. |
| 2011/0112462 | A1 | 5/2011 | Parker et al. |
| 2011/0116666 | A1 | 5/2011 | Dittberner et al. |
| 2011/0152602 | A1 | 6/2011 | Perkins et al. |
| 2011/0182453 | A1 | 7/2011 | Van Hal et al. |
| 2011/0221391 | A1 | 9/2011 | Won et al. |
| 2011/0258839 | A1 | 10/2011 | Probst |
| 2012/0008807 | A1 | 1/2012 | Gran |
| 2012/0014546 | A1 | 1/2012 | Puria et al. |
| 2012/0038881 | A1 | 2/2012 | Amirparviz et al. |
| 2012/0039493 | A1 | 2/2012 | Rucker et al. |
| 2012/0140967 | A1 | 6/2012 | Aubert et al. |
| 2012/0236524 | A1 | 9/2012 | Pugh et al. |
| 2013/0004004 | A1 | 1/2013 | Zhao et al. |
| 2013/0034258 | A1 | 2/2013 | Lin |
| 2013/0083938 | A1 | 4/2013 | Bakalos et al. |
| 2013/0287239 | A1 | 10/2013 | Fay et al. |
| 2013/0308782 | A1 | 11/2013 | Dittberner et al. |
| 2013/0343584 | A1 | 12/2013 | Bennett et al. |
| 2013/0343585 | A1 | 12/2013 | Bennett et al. |
| 2014/0003640 | A1 | 1/2014 | Puria et al. |
| 2014/0056453 | A1 | 2/2014 | Olsen et al. |
| 2014/0153761 | A1 | 6/2014 | Shennib et al. |
| 2014/0169603 | A1 | 6/2014 | Sacha et al. |
| 2014/0254856 | A1 | 9/2014 | Blick et al. |
| 2014/0286514 | A1 | 9/2014 | Pluvinage et al. |
| 2014/0288356 | A1 | 9/2014 | Van Vlem |
| 2014/0296620 | A1 | 10/2014 | Puria et al. |
| 2014/0321657 | A1 | 10/2014 | Stirnemann |
| 2014/0379874 | A1 | 12/2014 | Starr et al. |
| 2015/0023540 | A1 | 1/2015 | Fay et al. |
| 2015/0031941 | A1 | 1/2015 | Perkins et al. |
| 2015/0201269 | A1 | 7/2015 | Dahl et al. |
| 2015/0222978 | A1 | 8/2015 | Murozaki et al. |
| 2015/0271609 | A1 | 9/2015 | Puria |
| 2016/0029132 | A1 | 1/2016 | Freed et al. |
| 2016/0064814 | A1 | 3/2016 | Jang et al. |
| 2016/0066101 | A1 | 3/2016 | Puria et al. |
| 2016/0150331 | A1 | 5/2016 | Wenzel |
| 2016/0183017 | A1 | 6/2016 | Rucker et al. |
| 2016/0277854 | A1 | 9/2016 | Puria et al. |
| 2016/0302011 | A1 | 10/2016 | Olsen et al. |
| 2016/0309265 | A1 | 10/2016 | Pluvinage et al. |
| 2016/0309266 | A1 | 10/2016 | Olsen et al. |
| 2017/0095167 | A1 | 4/2017 | Facteau et al. |
| 2017/0095202 | A1 | 4/2017 | Facteau et al. |
| 2017/0134866 | A1 | 5/2017 | Puria et al. |
| 2017/0150275 | A1 | 5/2017 | Puria et al. |
| 2017/0195801 | A1 | 7/2017 | Rucker et al. |
| 2017/0195804 | A1 | 7/2017 | Sandhu et al. |
| 2017/0195806 | A1 | 7/2017 | Atamaniuk et al. |
| 2017/0195809 | A1 | 7/2017 | Teran et al. |
| 2018/0167750 | A1 | 6/2018 | Freed et al. |

FOREIGN PATENT DOCUMENTS

| | | | |
|---|---|---|---|
| DE | 3243850 | A1 | 5/1984 |
| DE | 3508830 | A1 | 9/1986 |
| EP | 0092822 | A2 | 11/1983 |
| EP | 0242038 | A2 | 10/1987 |
| EP | 0291325 | A2 | 11/1988 |
| EP | 0296092 | A2 | 12/1988 |
| EP | 0242038 | A3 | 5/1989 |
| EP | 0296092 | A3 | 8/1989 |
| EP | 0352954 | A2 | 1/1990 |
| EP | 0291325 | A3 | 6/1990 |
| EP | 0352954 | A3 | 8/1991 |
| EP | 1845919 | A1 | 10/2007 |
| EP | 1845919 | B1 | 9/2010 |
| FR | 2455820 | A1 | 11/1980 |
| JP | S60154800 | A | 8/1985 |
| JP | H09327098 | A | 12/1997 |
| JP | 2000504913 | A | 4/2000 |
| JP | 2004187953 | A | 7/2004 |
| KR | 100624445 | B1 | 9/2006 |
| WO | WO-9209181 | A1 | 5/1992 |
| WO | WO-9621334 | A1 | 7/1996 |
| WO | WO-9736457 | A1 | 10/1997 |
| WO | WO-9745074 | A1 | 12/1997 |
| WO | WO-9806236 | A1 | 2/1998 |
| WO | WO-9903146 | A1 | 1/1999 |
| WO | WO-9915111 | A1 | 4/1999 |
| WO | WO-0022875 | A2 | 4/2000 |
| WO | WO-0022875 | A3 | 7/2000 |
| WO | WO-0150815 | A1 | 7/2001 |
| WO | WO-0158206 | A2 | 8/2001 |
| WO | WO-0176059 | A2 | 10/2001 |
| WO | WO-0158206 | A3 | 2/2002 |
| WO | WO-0239874 | A2 | 5/2002 |
| WO | WO-0239874 | A3 | 2/2003 |
| WO | WO-03063542 | A2 | 7/2003 |
| WO | WO-03063542 | A3 | 1/2004 |
| WO | WO-2004010733 | A1 | 1/2004 |
| WO | WO-2005015952 | A1 | 2/2005 |
| WO | WO-2005107320 | A1 | 11/2005 |
| WO | WO-2006014915 | A2 | 2/2006 |
| WO | WO-2006037156 | A1 | 4/2006 |
| WO | WO-2006042298 | A2 | 4/2006 |
| WO | WO-2006075169 | A1 | 7/2006 |
| WO | WO-2006075175 | A1 | 7/2006 |
| WO | WO-2006118819 | A2 | 11/2006 |
| WO | WO-2006042298 | A3 | 12/2006 |
| WO | WO-2009046329 | A1 | 4/2009 |
| WO | WO-2009047370 | A2 | 4/2009 |
| WO | WO-2009049320 | A1 | 4/2009 |
| WO | WO-2009056167 | A1 | 5/2009 |
| WO | WO-2009047370 | A3 | 7/2009 |
| WO | WO-2009145842 | A2 | 12/2009 |
| WO | WO-2009146151 | A2 | 12/2009 |
| WO | WO-2009155358 | A1 | 12/2009 |
| WO | WO-2009155361 | A1 | 12/2009 |
| WO | WO-2010033932 | A1 | 3/2010 |
| WO | WO-2010033933 | A1 | 3/2010 |
| WO | WO-2010077781 | A2 | 7/2010 |
| WO | WO-2012088187 | A2 | 6/2012 |
| WO | WO-2012149970 | A1 | 11/2012 |
| WO | WO-2016011044 | A1 | 1/2016 |
| WO | WO-2017116791 | A1 | 7/2017 |
| WO | WO-2017116865 | A1 | 7/2017 |

OTHER PUBLICATIONS

Co-pending U.S. Appl. No. 15/706,208, filed Sep. 15, 2017.
Co-pending U.S. Appl. No. 15/706,236, filed Sep. 15, 2017.
Co-pending U.S. Appl. No. 15/718,398, filed Sep. 28, 2017.
Office Action dated May 8, 2017 for U.S. Appl. No. 14/949,495.
Office Action dated Sep. 2, 2016 for U.S. Appl. No. 14/949,495.
Struck, et al. Comparison of Real-world Bandwidth in Hearing Aids vs Earlens Light-driven Hearing Aid System. The Hearing Review. TechTopic: EarLens. Hearingreview.com. Mar. 14, 2017. pp. 24-28.

(56) References Cited

OTHER PUBLICATIONS

Asbeck, et al. Scaling Hard Vertical Surfaces with Compliant Microspine Arrays, The International Journal of Robotics Research 2006; 25; 1165-79.
Atasoy [Paper] Opto-acoustic Imaging. For BYM504E Biomedical Imaging Systems class at ITU, downloaded from the Internet www2.itu.edu.td—cilesiz/courses/BYM504- 2005-OA504041413.pdf, 14 pages.
Athanassiou, et al. Laser controlled photomechanical actuation of photochromic polymers Microsystems. Rev. Adv. Mater. Sci. 2003; 5:245-251.
Autumn, et al. Dynamics of geckos running vertically, The Journal of Experimental Biology 209, 260-272, (2006).
Autumn, et al., Evidence for van der Waals adhesion in gecko setae, www.pnas.orgycgiydoiy10.1073ypnas.192252799 (2002).
Ayatollahi, et al. Design and Modeling of Micromachined Condenser MEMS Loudspeaker using Permanent Magnet Neodymium-Iron-Boron (Nd—Fe—B). IEEE International Conference on Semiconductor Electronics, 2006. ICSE '06, Oct. 29, 2006-Dec. 1, 2006; 160-166.
Baer, et al. Effects of Low Pass Filtering on the Intelligibility of Speech in Noise for People With and Without Dead Regions at High Frequencies. J. Acost. Soc. Am 112 (3), pt. 1, (Sep. 2002), pp. 1133-1144.
Best, et al. The influence of high frequencies on speech localization. Abstract 981 (Feb. 24, 2003) from www.aro.org/abstracts/abstracts.html.
Birch, et al. Microengineered systems for the hearing impaired. IEE Colloquium on Medical Applications of Microengineering, Jan. 31, 1996; pp. 2/1-2/5.
Boedts. Tympanic epithelial migration, Clinical Otolaryngology 1978, 3, 249-253.
Burkhard, et al. Anthropometric Manikin for Acoustic Research. J. Acoust. Soc. Am., vol. 58, No. 1, (Jul. 1975), pp. 214-222.
Camacho-Lopez, et al. Fast Liquid Crystal Elastomer Swims Into the Dark, Electronic Liquid Crystal Communications. Nov. 26, 2003; 9 pages total.
Carlile, et al. Frequency bandwidth and multi-talker environments. Audio Engineering Society Convention 120. Audio Engineering Society, May 20-23, 2006. Paris, France. 118: 8 pages.
Carlile, et al. Spatialisation of talkers and the segregation of concurrent speech. Abstract 1264 (Feb. 24, 2004) from www.aro.org/abstracts/abstracts.html.
Cheng; et al., "A silicon microspeaker for hearing instruments. Journal of Micromechanics and Microengineering 14, No. 7 (2004): 859-866."
Cheng, et al. A Silicon Microspeaker for Hearing Instruments. Journal of Micromechanics and Microengineering 2004; 14(7):859-866.
Datskos, et al. Photoinduced and thermal stress in silicon microcantilevers. Applied Physics Letters. Oct. 19, 1998; 73(16):2319-2321.
Decraemer, et al. A method for determining three-dimensional vibration in the ear. Hearing Res., 77:19-37 (1994).
Ear. Downloaded from the Internet. Accessed Jun. 17, 2008. 4 pages. URL:< http://wwwmgs.bionet.nsc.ru/mgs/gnw/trrd/thesaurus/Se/ear.html>.
European search report and opinion dated Sep. 25, 2013 for EP Application No. 08837672.8.
Fay. Cat eardrum mechanics. Ph.D. thesis. Disseration submitted to Department of Aeronautics and Astronautics. Standford University. May 2001; 210 pages total.
Fay, et al. Cat eardrum response mechanics. Mechanics and Computation Division. Department of Mechanical Engineering. Standford University. 2002; 10 pages total.
Fay, et al. Preliminary evaluation of a light-based contact hearing device for the hearing impaired. Otol Neurotol. Jul. 2013;34(5):912-21. doi: 10.1097/MAO.0b013e31827de4b1.
Fay, et al. The discordant eardrum, PNAS, Dec. 26, 2006, vol. 103, No. 52, p. 19743-19748.
Fletcher. Effects of Distortion on the Individual Speech Sounds. Chapter 18, ASA Edition of Speech and Hearing in Communication, Acoust Soc.of Am. (republished in 1995) pp. 415-423.
Freyman, et al. Spatial Release from Informational Masking in Speech Recognition. J. Acost. Soc. Am., vol. 109, No. 5, pt. 1, (May 2001); 2112-2122.
Freyman, et al. The Role of Perceived Spatial Separation in the Unmasking of Speech. J. Acoust. Soc. Am., vol. 106, No. 6, (Dec. 1999); 3578-3588.
Fritsch, et al. EarLens transducer behavior in high-field strength MRI scanners. Otolaryngol Head Neck Surg. Mar. 2009;140(3):426-8. doi: 10.1016/j.otohns.2008.10.016.
Gantz, et al. Broad Spectrum Amplification with a Light Driven Hearing System. Combined Otolaryngology Spring Meetings, 2016 (Chicago).
Gantz, et al. Light Driven Hearing Aid: A Multi-Center Clinical Study. Association for Research in Otolaryngology Annual Meeting, 2016 (San Diego).
Gantz, et al. Light-Driven Contact Hearing Aid for Broad Spectrum Amplification: Safety and Effectiveness Pivotal Study. Otology & Neurotology Journal, 2016 (in review).
Gantz, et al. Light-Driven Contact Hearing Aid for Broad-Spectrum Amplification: Safety and Effectiveness Pivotal Study. Otology & Neurotology. Copyright 2016. 7 pages.
Ge, et al., Carbon nanotube-based synthetic gecko tapes, p. 10792-10795, PNAS, Jun. 26, 2007, vol. 104, No. 26.
Gennum, GA3280 Preliminary Data Sheet: Voyageur TD Open Platform DSP System for Ultra Low Audio Processing, downloaded from the Internet:<< http://www.sounddesigntechnologies.com/products/pdf/37601DOC.pdf>>, Oct. 2006; 17 pages.
Gobin, et al. Comments on the physical basis of the active materials concept. Proc. SPIE 2003; 4512:84-92.
Gorb, et al. Structural Design and Biomechanics of Friction-Based Releasable Attachment Devices in Insects, Integr. Comp_ Biol., 42:1127-1139 (2002).
Hato, et al. Three-dimensional stapes footplate motion in human temporal bones. Audiol. Neurootol., 8:140-152 (Jan. 30, 2003).
Headphones. Wikipedia Entry. Downloaded from the Internet. Accessed Oct. 27, 2008. 7 pages. URL: http://en.wikipedia.org/wiki/Headphones>.
Hofman, et al. Relearning Sound Localization With New Ears. Nature Neuroscience, vol. 1, No. 5, (Sep. 1998); 417-421.
International search report and written opinion dated Dec. 24, 2008 for PCT/US2008/079868.
Izzo, et al. Laser Stimulation of Auditory Neurons: Effect of Shorter Pulse Duration and Penetration Depth. Biophys J. Apr. 15, 2008;94(8):3159-3166.
Izzo, et al. Laser Stimulation of the Auditory Nerve. Lasers Surg Med. Sep. 2006;38(8):745-753.
Izzo, et al. Selectivity of Neural Stimulation in the Auditory System: A Comparison of Optic and Electric Stimuli. J Biomed Opt. Mar.-Apr. 2007;12(2):021008.
Jian, et al. A 0.6 V, 1.66 mW energy harvester and audio driver for tympanic membrane transducer with wirelessly optical signal and power transfer. InCircuits and Systems (ISCAS), 2014 IEEE International Symposium on Jun. 1, 2014. 874-7. IEEE.
Jin, et al. Speech Localization. J. Audio Eng. Soc. convention paper, presented at the AES 112th Convention, Munich, Germany, May 10-13, 2002, 13 pages total.
Khaleghi, et al. Characterization of Ear-Canal Feedback Pressure due to Umbo-Drive Forces: Finite-Element vs. Circuit Models. ARO Midwinter Meeting 2016, (San Diego).
Killion, et al. The case of the missing dots: AI and SNR loss. The Hearing Journal, 1998. 51(5), 32-47.
Killion. Myths About Hearing Noise and Directional Microphones. The Hearing Review. Feb. 2004; 11(2):14, 16, 18, 19, 72 & 73.
Killion. SNR loss: I can hear what people say but I can't understand them. The Hearing Review, 1997; 4(12):8-14.
Lee, et al. A Novel Opto-Electromagnetic Actuator Coupled to the tympanic Membrane. J Biomech. Dec. 5, 2008;41(16):3515-8. Epub Nov. 7, 2008.

(56) References Cited

OTHER PUBLICATIONS

Lee, et al. The optimal magnetic force for a novel actuator coupled to the tympanic membrane: a finite element analysis. Biomedical engineering: applications, basis and communications. 2007; 19(3):171-177.
Levy, et al. Characterization of the available feedback gain margin at two device microphone locations, in the fossa triangularis and Behind the Ear, for the light-based contact hearing device. Acoustical Society of America (ASA) meeting, 2013 (San Francisco).
Levy, et al. Extended High-Frequency Bandwidth Improves Speech Reception in the Presence of Spatially Separated Masking Speech. Ear Hear. Sep.-Oct. 2015;36(5):e214-24. doi: 10.1097/AUD.0000000000000161.
Lezal. Chalcogenide glasses—survey and progress. Journal of Optoelectronics and Advanced Materials. Mar. 2003; 5(1):23-34.
Makino, et al. Epithelial migration in the healing process of tympanic membrane perforations. Eur Arch Otorhinolaryngol. 1990; 247: 352-355.
Makino, et al., Epithelial migration on the tympanic membrane and external canal, Arch Otorhinolaryngol (1986) 243:39-42.
Markoff. Intuition + Money: An Aha Moment. New York Times Oct. 11, 2008, p. BU4, 3 pages total.
Martin, et al. Utility of Monaural Spectral Cues is Enhanced in the Presence of Cues to Sound-Source Lateral Angle. JARO. 2004; 5:80-89.
Michaels, et al., Auditory Epithelial Migration on the Human Tympanic Membrane: II. The Existence of Two Discrete Migratory Pathways and Their Embryologic Correlates, The American Journal of Anatomy 189:189-200 (1990).
Moore, et al. Perceived naturalness of spectrally distorted speech and music. J Acoust Soc Am. Jul. 2003;114(1):408-19.
Moore, et al. Spectro-temporal characteristics of speech at high frequencies, and the potential for restoration of audibility to people with mild-to-moderate hearing loss. Ear Hear. Dec. 2008;29(6):907-22. doi: 10.1097/AUD.0b013e31818246f6.
Moore. Loudness perception and intensity resolution. Cochlear Hearing Loss, Chapter 4, pp. 90-115, Whurr Publishers Ltd., London (1998).
Murphy M, Aksak B, Sitti M. Adhesion and anisotropic friction enhancements of angled heterogeneous micro-fiber arrays with spherical and spatula tips. J Adhesion Sci Technol, vol. 21, No. 12-13, p. 1281-1296, 2007.
Murugasu, et al. Malleus-to-footplate versus malleus-to-stapes-head ossicular reconstruction prostheses: temporal bone pressure gain measurements and clinical audiological data. Otol Neurotol. Jul. 2005; 2694):572-582.
Musicant, et al. Direction-Dependent Spectral Properties of Cat External Ear: New Data and Cross-Species Comparisons. J. Acostic. Soc. Am, May 10-13, 2002, vol. 87, No. 2, (Feb. 1990), pp. 757-781.
National Semiconductor, LM4673 Boomer: Filterless, 2.65W, Mono, Class D Audio Power Amplifier, [Data Sheet] downloaded from the Internet:<< http://www.national.com/ds/LM/LM4673.pdf>>; Nov. 1, 2007; 24 pages.
Nishihara, et al. Effect of changes in mass on middle ear function. Otolaryngol Head Neck Surg. Nov. 1993;109(5):889-910.
Notice of allowance dated May 1, 2015 for U.S. Appl. No. 13/768,825.
Notice of allowance dated Aug. 25, 2015 for U.S. Appl. No. 13/768,825.
Notice of allowance dated Nov. 27, 2012 for U.S. Appl. No. 12/251,200.
O'Connor, et al. Middle ear Cavity and Ear Canal Pressure-Driven Stapes Velocity Responses in Human Cadaveric Temporal Bones. J Acoust Soc Am. Sep. 2006;120(3):1517-28.
Office action dated May 17, 2012 for U.S. Appl. No. 12/251,200.
Office action dated Jul. 17, 2014 for U.S. Appl. No. 13/768,825.
Office action dated Nov. 14, 2011 for U.S. Appl. No. 12/251,200.
Office action dated Dec. 31, 2014 for U.S. Appl. No. 13/768,825.
Park, et al. Design and analysis of a microelectromagnetic vibration transducer used as an implantable middle ear hearing aid. J. Micromech. Microeng. vol. 12 (2002), pp. 505-511.
Perkins, et al. Light-based Contact Hearing Device: Characterization of available Feedback Gain Margin at two device microphone locations. Presented at AAO-HNSF Annual Meeting, 2013 (Vancouver).
Perkins, et al. The EarLens Photonic Transducer: Extended bandwidth. Presented at AAO-HNSF Annual Meeting, 2011 (San Francisco).
Perkins, et al. The EarLens System: New sound transduction methods. Hear Res. Feb. 2, 2010; 10 pages total.
Perkins, R. Earlens tympanic contact transducer: a new method of sound transduction to the human ear. Otolaryngol Head Neck Surg. Jun. 1996;114(6):720-8.
Poosanaas, et al. Influence of sample thickness on the performance of photostrictive ceramics, J. App. Phys. Aug. 1, 1998; 84(3):1508-1512.
Puria et al. A gear in the middle ear. ARO Denver CO, 2007b.
Puria, et al. Cues above 4 kilohertz can improve spatially separated speech recognition. The Journal of the Acoustical Society of America, 2011, 129, 2384.
Puria, et al. Extending bandwidth above 4 kHz improves speech understanding in the presence of masking speech. Association for Research in Otolaryngology Annual Meeting, 2012 (San Diego).
Puria, et al. Extending bandwidth provides the brain what it needs to improve hearing in noise. First international conference on cognitive hearing science for communication, 2011 (Linkoping, Sweden).
Puria, et al. Hearing Restoration: Improved Multi-talker Speech Understanding. 5th International Symposium on Middle Ear Mechanics in Research and Otology (MEMRO), Jun. 2009 (Stanford University).
Puria, et al. Imaging, Physiology and Biomechanics of the middle ear: Towards understating the functional consequences of anatomy. Stanford Mechanics and Computation Symposium, 2005, ed Fong J.
Puria, et al. Malleus-to-footplate ossicular reconstruction prosthesis positioning: cochleovestibular pressure optimization. Otol Nerotol. May 2005; 2693):368-379.
Puria, et al. Measurements and model of the cat middle ear: Evidence of tympanic membrane acoustic delay. J. Acoust. Soc. Am., 104(6):3463-3481 (Dec. 1998).
Puria, et al., Mechano-Acoustical Transformations in A. Basbaum et al., eds., The Senses: A Comprehensive Reference, v3, p. 165-202, Academic Press (2008).
Puria, et al. Middle Ear Morphometry From Cadaveric Temporal Bone MicroCT Imaging. Proceedings of the 4th International Symposium, Zurich, Switzerland, Jul. 27-30, 2006, Middle Ear Mechanics in Research and Otology, pp. 259-268.
Puria, et al. Sound-Pressure Measurements in the Cochlear Vestibule of Human-Cadaver Ears. Journal of the Acoustical Society of America. 1997; 101 (5-1): 2754-2770.
Puria, et al. Temporal-Bone Measurements of the Maximum Equivalent Pressure Output and Maximum Stable Gain of a Light-Driven Hearing System That Mechanically Stimulates the Umbo. Otol Neurotol. Feb. 2016;37(2):160-6. doi: 10.1097/MAO.0000000000000941.
Puria, et al. The EarLens Photonic Hearing Aid. Association for Research in Otolaryngology Annual Meeting, 2012 (San Diego).
Puria, et al. The Effects of bandwidth and microphone location on understanding of masked speech by normal-hearing and hearing-impaired listeners. International Conference for Hearing Aid Research (IHCON) meeting, 2012 (Tahoe City).
Puria, et al. Tympanic-membrane and malleus-incus-complex co-adaptations for high-frequency hearing in mammals. Hear Res. May 2010;263(1-2):183-90. doi: 10.1016/j.heares.2009.10.013. Epub Oct. 28, 2009.
Puria. Measurements of human middle ear forward and reverse acoustics: implications for otoacoustic emissions. J Acoust Soc Am. May 2003;113(5):2773-89.

(56) References Cited

OTHER PUBLICATIONS

Puria, S. Middle Ear Hearing Devices. Chapter 10. Part of the series Springer Handbook of Auditory Research pp. 273-308. Date: Feb. 9, 2013.
Qu, et al. Carbon Nanotube Arrays with Strong Shear Binding-On and Easy Normal Lifting-Off, Oct. 10, 2008 vol. 322 Science. 238-242.
Roush. SiOnyx Brings "Black Silicon" into the Light; Material Could Upend Solar, Imaging Industries. Xconomy, Oct. 12, 2008, retrieved from the Internet: www.xconomy.com/boston/2008/10/12/sionyx-brings-black-silicon-into-the-light¬material-could-upend-solar-imaging-industries> 4 pages total.
R.P. Jackson, C. Chlebicki, T.B. Krasieva, R. Zalpuri, W.J. Triffo, S. Puria, "Multiphoton and Transmission Electron Microscopy of Collagen in Ex Vivo Tympanic Membranes," Biomedcal Computation at STandford, Oct. 2008.
Rubinstein. How Cochlear Implants Encode Speech, Curr Opin Otolaryngol Head Neck Surg. Oct. 2004;12(5):444-8; retrieved from the Internet: www.ohsu.edu/nod/documents/week3/Rubenstein.pdf.
Sekaric, et al. Nanomechanical resonant structures as tunable passive modulators. App. Phys. Lett. Nov. 2003; 80(19):3617-3619.
Shaw. Transformation of Sound Pressure Level From the Free Field to the Eardrum in the Horizontal Plane. J. Acoust. Soc. Am., vol. 56, No. 6, (Dec. 1974), 1848-1861.
Shih. Shape and displacement control of beams with various boundary conditions via photostrictive optical actuators. Proc. IMECE. Nov. 2003; 1-10.
Song, et al. The development of a non-surgical direct drive hearing device with a wireless actuator coupled to the tympanic membrane. Applied Acoustics. Dec. 31, 2013;74(12):1511-8.
Sound Design Technologies,—Voyager TDTM Open Platform DSP System for Ultra Low Power Audio Processing—GA3280 Data Sheet. Oct. 2007; retrieved from the Internet:<< http://www.sounddes.com/pdf/37601DOC.pdf>>, 15 page total.
Spolenak, et al. Effects of contact shape on the scaling of biological attachments. Proc. R. Soc. A. 2005; 461:305-319.
Stenfelt, et al. Bone-Conducted Sound: Physiological and Clinical Aspects. Otology & Neurotology, Nov. 2005; 26 (6):1245-1261.
Stuchlik, et al. Micro-Nano Actuators Driven by Polarized Light. IEEE Proc. Sci. Meas. Techn. Mar. 2004; 151(2):131-136.
Suski, et al. Optically activated ZnO/Si02/Si cantilever beams. Sensors and Actuators A (Physical), 0 (nr: 24). 2003; 221-225.
Takagi, et al. Mechanochemical Synthesis of Piezoelectric PLZT Powder. KONA. 2003; 51(21):234-241.
Thakoor, et al. Optical microactuation in piezoceramics. Proc. SPIE. Jul. 1998; 3328:376-391.
The Scientist and Engineers Guide to Digital Signal Processing, copyright 01997-1998 by Steven W. Smith, available online at www.DSPguide.com.
Thompson. Tutorial on microphone technologies for directional hearing aids. Hearing Journal. Nov. 2003; 56(11):14-16,18, 20-21.
Tzou, et al. Smart Materials, Precision Sensors/Actuators, Smart Structures, and Structronic Systems. Mechanics of Advanced Materials and Structures. 2004; 11:367-393.
Uchino, et al. Photostricitve actuators. Ferroelectrics. 2001; 258:147-158.
Vickers, et al. Effects of Low-Pass Filtering on the Intelligibility of Speech in Quiet for People With and Without Dead Regions at High Frequencies. J. Acoust. Soc. Am. Aug. 2001; 110(2):1164-1175.
Vinikman-Pinhasi, et al. Piezoelectric and Piezooptic Effects in Porous Silicon. Applied Physics Letters, Mar. 2006; 88(11): 11905-111906.
Wang, et al. Preliminary Assessment of Remote Photoelectric Excitation of an Actuator for a Hearing Implant. Proceeding of the 2005 IEEE, Engineering in Medicine and Biology 27th nnual Conference, Shanghai, China. Sep. 1-4, 2005; 6233-6234.
Wiener, et al. On the Sound Pressure Transformation by the Head and Auditory Meatus of the Cat. Acta Otolaryngol. Mar. 1966; 61(3):255-269.
Wightman, et al. Monaural Sound Localization Revisited. J Acoust Soc Am. Feb. 1997;101(2):1050-1063.
Yao, et al. Adhesion and sliding response of a biologically inspired fibrillar surface: experimental observations, J. R. Soc. Interface (2008) 5, 723-733 doi:10.1098/rsif.2007.1225 Published online Oct. 30, 2007.
Yao, et al. Maximum strength for intermolecular adhesion of nanospheres at an optimal size. J. R. Soc. Interface doi:10.10981rsif.2008.0066 Published online 2008.
Yi, et al. Piezoelectric Microspeaker with Compressive Nitride Diaphragm. The Fifteenth IEEE International Conference on Micro Electro Mechanical Systems, 2002; 260-263.
Yu, et al. Photomechanics: Directed bending of a polymer film by light. Nature. Sep. 2003; 425:145.
Dundas et al. The Earlens Light-Driven Hearing Aid: Top 10 questions and answers. Hearing Review. 2018;25(2):36-39.
Khaleghi et al. Attenuating the ear canal feedback pressure of a laser-driven hearing aid. J Acoust Soc Am. Mar. 2017;141(3):1683.
Khaleghi et al. Attenuating the feedback pressure of a light-activated hearing device to allows microphone placement at the ear canal entrance. IHCON 2016, International Hearing Aid Research Conference, Tahoe City, CA, Aug. 2016.
Khaleghi et al. Mechano-Electro-Magnetic Finite Element Model of a Balanced Armature Transducer for a Contact Hearing Aid. Proc. MoH 2017, Mechanics of Hearing workshop, Brock University, Jun. 2017.
Khaleghi et al. Multiphysics Finite Element Model of a Balanced Armature Transducer used in a Contact Hearing Device. ARO 2017, 40th ARO MidWinter Meeting, Baltimore, MD, Feb. 2017.
Levy et al. Light-driven contact hearing aid: a removable direct-drive hearing device option for mild to severe sensorineural hearing impairment. Conference on Implantable Auditory Prostheses, Tahoe City, CA, Jul. 2017. 1 page.
McElveen et al. Overcoming High-Frequency Limitations of Air Conduction Hearing Devices Using a Light-Driven Contact Hearing Aid. Poster presentation at the Triological Society, 120th Annual Meeting at COSM, Apr. 28, 2017; San Diego, CA.
Co-pending U.S. Appl. No. 15/911,595, filed Mar. 5, 2018.
Co-pending U.S. Appl. No. 15/914,265, filed Mar. 7, 2018.
Co-pending U.S. Appl. No. 15/926,876, filed Mar. 20, 2018.
Co-pending U.S. Appl. No. 16/013,839, filed Jun. 20, 2018.
Galbraith et al. A wide-band efficient inductive transdermal power and data link with coupling insensitive gain IEEE Trans Biomed Eng. Apr. 1987;34(4):265-75.

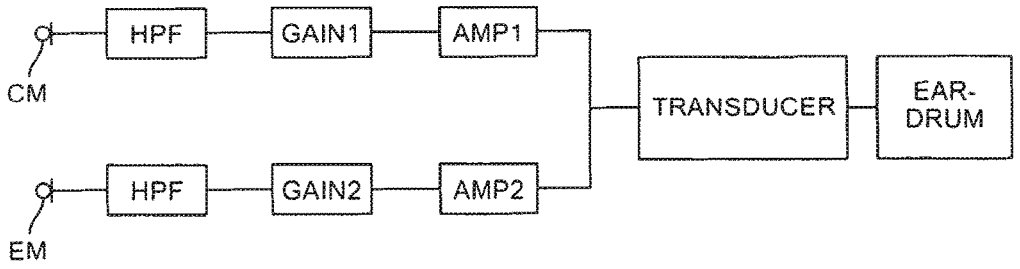
FIG. 10C
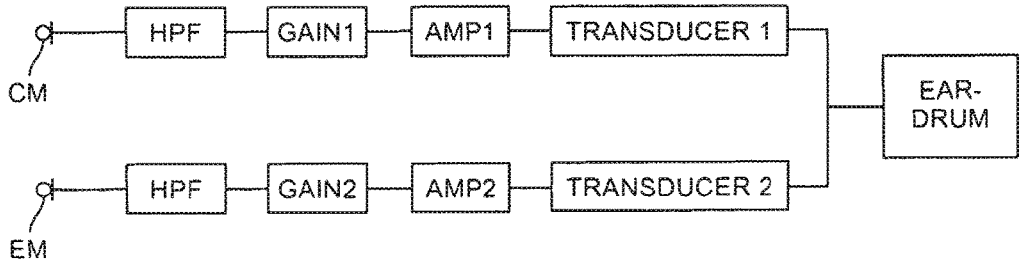
FIG. 10D1
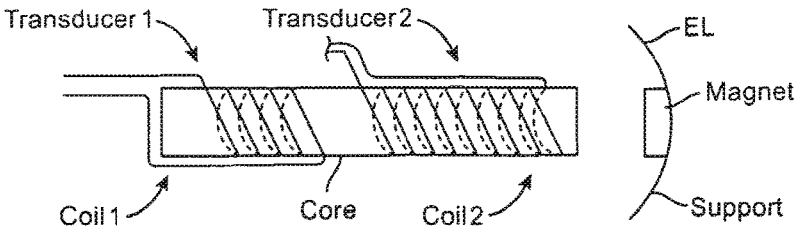
FIG. 10D2

MULTIFUNCTION SYSTEM AND METHOD FOR INTEGRATED HEARING AND COMMUNICATION WITH NOISE CANCELLATION AND FEEDBACK MANAGEMENT

CROSS REFERENCE TO RELATED APPLICATIONS DATA

The present application is a continuation of U.S. patent application Ser. No. 14/949,495, filed Nov. 23, 2015, which is a continuation of U.S. patent application Ser. No. 13/768,825, filed Feb. 15, 2013, now U.S. Pat. No. 9,226,083, which is a divisional of U.S. patent application Ser. No. 12/251,200, filed Oct. 14, 2008, now U.S. Pat. No. 8,401,212, which claims the benefit under 35 U.S.C. § 119(c) of U.S. Provisional Application No. 60/979,645 filed Oct. 12, 2007; the full disclosures of which are incorporated herein by reference in their entirety.

The subject matter of the present application is related to copending U.S. patent application Ser. No. 10/902,660 filed Jul. 28, 2004, entitled "Transducer for Electromagnetic Hearing Devices"; Ser. No. 11/248,459 filed on Oct. 11, 2005, entitled "Systems and Methods for Photo-Mechanical Hearing Transduction"; Ser. No. 11/121,517 filed May 3, 2005, entitled "Hearing System Having Improved High Frequency Response"; Ser. No. 11/264,594 filed on Oct. 31, 2005, entitled "Output Transducers for Hearing Systems"; 60/702,532 filed on Jul. 25, 2006, entitled "Light-Actuated. Silicon Sound Transducer"; 61/073,271 filed on Jun. 17, 2008, entitled "Optical Electro-Mechanical Hearing Devices With Combined Power and Signal Architectures"; 61/073,281 filed on Jun. 17, 2008, entitled "Optical Electro-Mechanical Hearing Devices with Separate Power and Signal Components"; U.S. Patent Application Ser. No. 61/099,087, filed on Sep. 22, 2008, entitled "Transducer Devices and Methods for Hearing"; and U.S. patent application Ser. No. 12/244,266, filed on Oct. 2, 2008, entitled "Energy Delivery and Microphone Placement Methods for Improved Comfort in an Open Canal Hearing Aid".

BACKGROUND OF THE INVENTION

1. Field of the Invention

The present invention is related to systems, devices and methods for communication.

People like to communicate with others. Hearing and speaking are forms of communication that many people use and enjoy. Many devices have been proposed that improve communication including the telephone and hearing aids.

Hearing impaired subjects need hearing aids to verbally communicate with those around them. Open canal hearing aids have proven to be successful in the marketplace because of increased comfort. Another reason why they are popular is reduced occlusion, which is a tunnel-like hearing effect that is problematic to most hearing aid users. Another common complaint is feedback and whistling from the hearing aid. Increasingly, hearing impaired subjects also make use of audio entertainment and communication devices. Often the use of these devices interferes with the use of hearing aids and more often are cumbersome to use together. Another problem is use of entertainment and communication systems in noisy environments, which requires active noise cancellation. There is a need to integrate open canal hearing aids with audio entertainment and communication systems and still allow their use in noisy places. For improving comfort, it is desirable to use these modalities in an open ear canal configuration.

Several approaches to improved hearing, improve feedback suppression and noise cancellation. Although sometimes effective, current methods and devices for feedback suppression and noise cancellation may not be effective in at least some instances. For example, when an acoustic hearing aid with a speaker positioned in the ear canal is used to amplify sound, placement of a microphone in the car canal can result in feedback when the ear canal is open, even when feedback and noise cancellation are used.

One promising approach to improving hearing with an ear canal microphone has been to use a direct-drive transducer coupled to middle-ear transducer, rather than an acoustic transducer, such that feedback is significantly reduced and often limited to a narrow range of frequencies. The EARLENS™ transducer as described by Perkins et al (U.S. Pat. No. 5,259,032; US20060023908; US20070100197) and many other transducers that directly couple to the middle ear such as described by Puria et al (U.S. Pat. No. 6,629,922) may have significant advantages due to reduced feedback that is limited in a narrow frequency range. The EARLENS™ system may use an electromagnetic coil placed inside the ear canal to drive the middle ear, for example with the EARLENS™ transducer magnet positioned on the eardrum. A microphone can be placed inside the ear canal integrated in a wide-bandwidth system to provide pinna-diffraction cues. The pinna diffraction cues allow the user to localize sound and thus hear better in multi-talker situations, when combined with the wide-bandwidth system. Although effective in reducing feedback, these systems may result in feedback in at least some instances, for example with an open ear canal that transmits sound to a canal microphone with high gain for the hearing impaired.

Although at least some implantable hearing aid systems may result in decreased feedback, surgical implantation can be complex, expensive and may potentially subject the user to possible risk of surgical complications and pain such that surgical implantation is not a viable option for many users.

In at least some instances known hearing aides may not be fully integrated with telecommunications systems and audio system, such that the user may use more devices than would be ideal. Also, current combinations of devices may be less than ideal, such that the user may not receive the full benefit of hearing with multiple devices. For example, known hands free wireless BLUETOOTH™ devices, such as the JAWBONE™, may not work well with hearing aid devices as the hands free device is often placed over the ear. Also, such devices may not have sounds configured for optimal hearing by the user as with hearing aid devices. Similarly, a user of a hearing aid device, may have difficulty using direct audio from device such as a headphone jack for listening to a movie on a flight, an iPod or the like. In many instances, the result is that the combination of known hearing devices with communication and audio systems can be less than ideal.

The known telecommunication and audio systems may have at least some shortcomings, even when used alone, that may make at least some of these systems less than ideal, in at least some instances. For example, many known noise cancellation systems use headphones that can be bulky, in at least some instances. Further, at least some of the known wireless headsets for telecommunications can be some what obtrusive and visible, such that it would be helpful if the visibility and size could be minimized.

In light of the above, it would be desirable to provide an improved system for communication that overcomes at least some of the above shortcomings. It would be particularly desirable if such a communication system could be used without surgery to provide: high frequency localization cues, open ear canal hearing with minimal feedback, hearing aid functionality with amplified sensation level, a wide bandwidth sound with frequencies from about 0.1 to 10 kHz, noise cancellation, reduced feedback, communication with a mobile device or audio entertainment system.

2. Description of the Background Art

The following U.S. patents and publications may be relevant to the present application: U.S. Pat. Nos. 5,117,461; 5,259,032; 5,402,496; 5,425,104; 5,740,258; 5,940,519; 6,068,589; 6,222,927; 6,629,922; 6,445,799; 6,668,062; 6,801,629; 6,888,949; 6,978,159; 7,043,037; 7,203,331; 2002/20172350; 006/0023908; 2006/0251278; 2007/0100197; Carlile and Schonstein (2006) "Frequency bandwidth and multi-talker environments," Audio Engineering Society Convention, Paris, France 118:353-63; Killion, M. C. and Christensen, L. (1998) "The case of the missing dots: AI and SNR loss," Hear Jour 51(5):32-47; Moore and Tan (2003) "Perceived naturalness of spectrally distorted speech and music," J Acoust Soc Am 114(1):408-19; Puria (2003) "Measurements of human middle ear forward and reverse acoustics: implications for otoacoustic emissions," J Acoust Soc Am 113(5):2773-89.

BRIEF SUMMARY OF THE INVENTION

Embodiments of the present invention provide improved systems, devices and methods for communication. Although specific reference is made to communication with a hearing aid, the systems methods and devices, as described herein, can be used in many applications where sound is used for communication. At least some of the embodiments can provide, without surgery, at least one of: hearing aid functionality, an open ear canal; an ear canal microphone; wide bandwidth, for example with frequencies from about 0.1 to about 10 kHz; noise cancellation; reduced feedback, communication with at least one of a mobile device; or communication with an audio entertainment system. The ear canal microphone can be configured for placement to detect high frequency sound localization cues, for example within the ear canal or outside the ear canal within about 5 mm of the ear canal opening so as to detect high frequency sound comprising localization cues from the pinna of the ear. The high frequency sound detected with the ear canal microphone may comprise sound frequencies above resonance frequencies of the ear canal, for example resonance frequencies from about 2 to about 3 kHz. An external microphone can be positioned away from the ear canal to detect low frequency sound at or below the resonance frequencies of the ear canal, such that feedback can be substantially reduced, even minimized or avoided. The canal microphone and the external microphone can be coupled to at least one output transducer, such that the user perceives sound from the external microphone and the canal microphone with high frequency localization cues and decreased feedback. Wireless circuitry can be configured to connect to many devices with a wireless protocol, such that the user can receive and transmit audio signals. A bone conduction sensor can detect near-end speech of the user for transmission with the wireless circuitry, for example in a noisy environment with a piezo electric positioner configured for placement in the ear canal. Noise cancellation of background sounds near the user can improve the user's hearing of desired sounds, for example noised cancellation of background sounds detected with the external microphone.

In a first aspect, embodiments of the present invention provide a communication device for use with an ear of a user. A first input transducer is configured for placement at least one of inside an ear canal or near an opening of the ear canal. A second input transducer is configured for placement outside the ear canal. At least one transducer configured for placement inside the ear canal of the user. The at least one output transducer is coupled to the first microphone and the second microphone to transmit sound from the first microphone and the second microphone to the user.

In many embodiments, the first input transducer comprises at least one of a first microphone configured to detect sound from air or a first acoustic sensor configured to detect vibration from tissue. The second input transducer comprises at least one of a second microphone configured to detect sound from air or a second acoustic sensor configured to detect vibration from tissue. The first input transducer may comprise a microphone configured to detect high frequency localization cues and wherein the at least one output transducer is acoustically coupled to first input transducer when the transducer is positioned in the ear canal. The second input transducer can be positioned away from the ear canal opening to minimize feedback when the first input transducer detects the high frequency localization cues.

In many embodiments, the first input transducer is configured to detect high frequency sound comprising spatial localization cues when placed inside the ear canal or near the ear canal opening and transmit the high frequency localization cues to the user. The high frequency localization cues may comprise frequencies above about 4 kHz. The first input transducer can be coupled to the at least one output transducer to transmit high frequencies above at least about 4 kHz to the user with a first gain and to transmit low frequencies below about 3 kHz with a second gain. The first gain can be greater than the second gain so as to minimize feedback from the transducer to the first input transducer. The first input transducer can be configured to detect at least one of a sound diffraction cue from a pinna of the ear of the user or a head shadow cue from a head of the user when the first input transducer is positioned at least one of inside the ear canal or near the opening of the ear canal.

In many embodiments, the first input transducer is coupled to the at least one output transducer to vibrate an eardrum of the ear in response to high frequency sound localization cues above a resonance frequency of the ear canal. The second input transducer is coupled to the at least one output transducer to vibrate the eardrum in response sound frequencies at or below the resonance frequency of the ear canal. The resonance frequency of the ear canal may comprise frequencies within a range from about 2 to 3 kHz.

In many embodiments, the first input transducer is coupled to the at least one output transducer to vibrate the eardrum with a resonance gain for first sound frequencies corresponding to the resonance frequencies of the ear canal and a cue gain for sound localization cue comprising frequencies above the resonance frequencies of the ear canal, and wherein the cue gain is greater than the resonance gain to minimize feedback.

In many embodiments, the first input transducer is coupled to the at least one output transducer to vibrate the eardrum with a first gain for first sound frequencies corresponding to the resonance frequencies of the ear canal. The second input transducer is coupled to the at least one output transducer to vibrate the eardrum with a second gain for the sound frequencies corresponding to the resonance frequencies of the ear canal, and the first gain is less than the second gain to minimize feedback.

In many embodiments, the second input transducer is configured to detect low frequency sound without high frequency localization cues from a pinna of the ear when placed outside the ear canal to minimize feedback from the transducer. The low frequency sound may comprise frequencies below about 3 kHz.

In many embodiments, the device comprises circuitry coupled to the first input transducer, the second input transducer and the at least one output transducer, and the circuitry is coupled to the first input transducer and the at least one output transducer to transmit high frequency sound comprising frequencies above about 4 kHz from the first input transducer to the user. The circuitry can be coupled to the second input transducer and the at least one output transducer to transmit low frequency sound comprising frequencies below about 4 kHz front the second input transducer to the user. The circuitry may comprise at least one of a sound processor or an amplifier coupled to the first input transducer, the second input transducer and the at least one output transducer to transmit high frequencies front the first input transducer and low frequencies from the second input transducer to the user so as to minimize feedback.

In many embodiments, the at least one output transducer comprises a first transducer and a second transducer, in which the first transducer is coupled to the first input transducer to transmit high frequency sound and the second transducer coupled to the second input transducer to transmit low frequency sound.

In many embodiments, the first input transducer is coupled to the at least one output transducer to transmit first frequencies to the user with a first gain and the second input transducer is coupled to the at least one output transducer to transmit second frequencies to the user with a second gain.

In many embodiments, the at least one output transducer comprises at least one of an acoustic speaker configured for placement inside the ear canal, a magnet supported with a support configured for placement on an eardrum of the user, an optical transducer supported with a support configured for placement on the eardrum of the user, a magnet configured for placement in a middle ear of the user, and an optical transducer configured for placement in the middle ear of the user. The at least one output transducer may comprise the magnet supported with the support configured for placement on an eardrum of the user, and the at least one output transducer may further comprises at least one coil configured for placement in the ear canal to couple to the magnet to transmit sound to the user. The at least one coil may comprises a first coil and a second coil, in which the first coil is coupled to the first input transducer and configured to transmit first frequencies from the first input transducer to the magnet, and in which the second coil is coupled to the second input transducer and configured to transmit second frequencies from the second input transducer to the magnet. The at least one output transducer may comprise the optical transducer supported with the support configured for placement on the eardrum of the user, and the optical transducer may further comprise a photodetector coupled to at least one of a coil or a piezo electric transducer supported with the support and configured to vibrate the eardrum.

In many embodiments, the first input transducer is configured to generate a first audio signal and the second input transducer is configured to generate a second audio signal and wherein the at least one output transducer is configured to vibrate with a first gain in response to the first audio signal and a second gain in response to the second audio signal to minimize feedback.

In many embodiments, the device further comprises wireless communication circuitry configured to transmit near-end speech from the user to a far-end person when the user speaks. The wireless communication circuitry can be configured to transmit the near-end sound from at least one of the first input transducer or the second input transducer. The wireless communication circuitry can be configured to transmit the near-end sound from the second input transducer. A third input transducer can be coupled to the wireless communication circuitry, in which the third input transducer configured to couple to tissue of the patient and transmit near-end speech from the user to the far end person in response to bone conduction vibration when the user speaks.

In many embodiments, the device further comprises a second device for use with a second contralateral ear of the user. The second device comprises a third input transducer configured for placement inside a second ear canal or near an opening of the second ear canal to detect second high frequency localization cues. A fourth input transducer is configured for placement outside the second ear canal. A second at least one output transducer is configured for placement inside the second ear canal, and the second at least one output transducer is acoustically coupled to the third input transducer when the second at least one output transducer is positioned in the second ear canal. The fourth input transducer is positioned away from the second ear canal opening to minimize feedback when the third input transducer detects the second high frequency localization cues. The combination of the first and second input transducers on an ipsilateral ear and the third and fourth input transducers on a contralateral ear can lead to improved binaural hearing.

In another aspect, embodiments of the present invention provide a communication device for use with an ear of a user. The device comprises a first at least one input transducer configured to detect sound. A second input transducer is configured to detect tissue vibration when the user speaks. Wireless communication circuitry is coupled to the second input transducer and configured to transmit near-end speech from the user to a far-end person when the user speaks. At least one output transducer is configured for placement inside an ear canal of the user, in which the at least one output transducer is coupled to the first input transducer to transmit sound from the first input transducer to the user.

In many embodiments, the first at least one input transducer comprises a microphone configured for placement at least one of inside an ear canal or near an opening of the ear canal to detect high frequency localization cues. Alternatively or in combination, the first at least one input transducer may comprise a microphone configured for placement outside the ear canal to detect low frequency speech and minimize feedback from the at least one output transducer.

In many embodiments, the second input transducer comprises at least one of an optical vibrometer or a laser vibrometer configured to generate a signal in response to vibration of the eardrum when the user speaks.

In many embodiments, the second input transducer comprises a bone conduction sensor configured to couple to a skin of the user to detect tissue vibration when the user speaks. The bone conduction sensor can be configured for placement within the car canal.

In many embodiments, the device further comprises an elongate support configured to extend from the opening toward the eardrum to deliver energy to the at least one output transducer, and a positioner coupled to the elongate support. The positioner can be sized to fit in the ear canal and position the elongate support within the car canal, and the positioner may comprise the bone conduction sensor. The bone conduction sensor may comprise a piezo electric transducer configured to couple to the ear canal to bone vibration when the user speaks.

In many embodiments, the at least one output transducer comprises a support configured for placement on an eardrum of the user.

In many embodiments, the wireless communication circuitry is configured to receive sound from at least one of a cellular telephone, a hands free wireless device of an automobile, a paired short range wireless connectivity system, a wireless communication network, or a Win network.

In many embodiments, the wireless communication circuitry is coupled to the at least one output transducer to transmit far-end sound to the user from a far-end person in response to speech from the far-end person.

In another aspect, embodiments of the present invention provide an audio listening system for use with an ear of a user. The system comprises a canal microphone configured for placement in an ear canal of the user, and an external microphone configured for placement external to the ear canal. A transducer is coupled to the canal microphone and the external microphone. The transducer is configured for placement inside the ear canal on an eardrum of the user to vibrate the eardrum and transmit sound to the user in response to the canal microphone and the external microphone.

In many embodiments, the transducer comprises a magnet and a support configured for placement on the eardrum to vibrate the eardrum in response to a wide bandwidth signal comprising frequencies from about 0.1 kHz to about 10 kHz.

In many embodiments, the system further comprises a sound processor coupled to the canal microphone and configured to receive an input from the canal microphone. The sound processor is configured to vibrate the eardrum in response to the input from the canal microphone. The sound processor can be configured to minimize feedback from the transducer.

In many embodiments, the sound processor is coupled to the external microphone and configured to vibrate the eardrum in response to an input from the external microphone.

In many embodiments, the sound processor is configured to cancel feedback from the transducer to the canal microphone with a feedback transfer function.

In many embodiments, the sound processor is coupled to the external microphone and configured to cancel noise in response to input from the external microphone. The external microphone can be configured to measure external sound pressure and wherein the sound processor is configured to minimize vibration of the eardrum in response to the external sound pressure measured with the external microphone. The sound processor can be configured to measure feedback from the transducer to the canal microphone and wherein the processor is configured to minimize vibration of the eardrum in response to the feedback.

In many embodiments, the external microphone is configured to measure external sound pressure, and the canal microphone is configured to measure canal sound pressure and wherein the sound processor is configured to determine feedback transfer function in response to the canal sound pressure and the external sound pressure.

In many embodiments, the system further comprises an external input for listening.

In many embodiments, the external input comprises an analog input configured to receive an analog audio signal from an external device.

In many embodiments, the system further comprises a bone vibration sensor to detect near-end speech of the user.

In many embodiments, the system further comprises wireless communication circuitry coupled to the transducer and configured to vibrate the transducer in response to far-end speech.

In many embodiments, the system further comprises a sound processor coupled to the wireless communication circuitry and wherein the sound processor is configured to process the far-end speech to generate processed far-end speech, and the processor is configured to vibrate the transducer in response to the processed far-end speech.

In many embodiments, wireless communication circuitry is configured to receive far-end speech from a communication channel of a mobile phone.

In many embodiments, the wireless communication circuitry is configured to transmit near-end speech of the user to a far-end person.

In many embodiments, the system further comprises a mixer configured to mix a signal from the canal microphone and a signal from the external microphone to generate a mixed signal comprising near-end speech, and the wireless communication circuitry is configured to transmit the mixed signal comprising the near-end speech to a far-end person.

In many embodiments, the sound processor is configured to provide mixed near-end speech to the user.

In many embodiments, the system is configured to transmit near-end speech from a noisy environment to a far-end person.

In many embodiments, the system further comprises a bone vibration sensor configured to detect near-end speech, the bone vibration sensor coupled to the wireless communication circuitry, and wherein the wireless communication circuitry is configured to transmit the near-end speech to the far-end person in response to bone vibration when the user speaks.

In another aspect, embodiments of the present invention provide a method of transmitting sound to an ear of a user. High frequency sound comprising high frequency localization cues is detected with a first microphone placed at least one of inside an ear canal or near an opening of the ear canal. A second microphone is placed external to the ear canal. At least one output transducer is placed inside the ear canal of the user. The at least one output transducer is coupled to the first microphone and the second microphone and transmits sound from the first microphone and the second microphone to the user.

In another aspect, embodiments of the present invention provide a device to detect sound from an ear canal of a user. The device comprises a piezo electric transducer configured for placement in the ear canal of the user.

In many embodiments, the piezo electric transducer comprises at least one elongate structure configured to extend at least partially across the ear canal from a first side of the ear canal to a second side of the ear canal to detect sound when the user speaks, in which the first side of the ear canal can be opposite the second side. The at least one elongate structure may comprise a plurality of elongate structures configured to extend at least partially across the long dimension of the ear canal, and a gap may extend at least partially between the plurality of elongate structures to minimize occlusion when the piezo electric transducer is placed in the canal.

In many embodiments, the device further comprises a positioner coupled to the transducer, in which the positioner is configured to contact the ear canal and support the piezoelectric transducer in the ear canal to detect vibration when the user speaks. The at least one of the positioner or the piezo electric transducer can be configured to define at least one aperture to minimize occlusion when the user speaks.

In many embodiments, the positioner comprises an outer portion configured extend circumferentially around the piezo electric transducer to contact the ear canal with an outer perimeter of the outer portion when the positioner is positioned in the ear canal.

In many embodiments, the device further comprises an elongate support comprising an elongate energy transmission structure, the elongate energy transmission structure passing through at least one of the piezo electric transducer or the positioner to transmit an audio signal to the eardrum of the user, the elongate energy transmission structure comprising at least one of an optical fiber to transmit light energy or a wire configured to transmit electrical energy.

In many embodiments, the piezo electric transducer comprises at least one of a ring piezo electric transducer, a bender piezo electric transducer, a bimorph bender piezo electric transducer or a piezoelectric multi-morph transducer, a stacked piezoelectric transducer with a mechanical multiplier or a ring piezoelectric transducer with a mechanical multiplier or a disk piezo electric transducer.

In another aspect, embodiments of the present invention provide an audio listening system having multiple functionalities. The system comprises a body configured for positioning in an open ear canal, the functionalities include a wide-bandwidth hearing aid, a microphone within the body, a noise suppression system, a feedback cancellation system, a mobile phone communication system, and an audio entertainment system.

BRIEF DESCRIPTION OF THF DRAWINGS

FIG. 8B-1 shows an elongate support configured to position a distal end of the elongate support with at least one positioner placed in an ear canal, according to embodiments of the present invention;

FIG. 10C shows a canal microphone with high pass filter circuitry and an external microphone with low pass filter circuitry, both coupled to a transducer to provide gain in response to frequency as in FIG. 10B;

Figure 1:
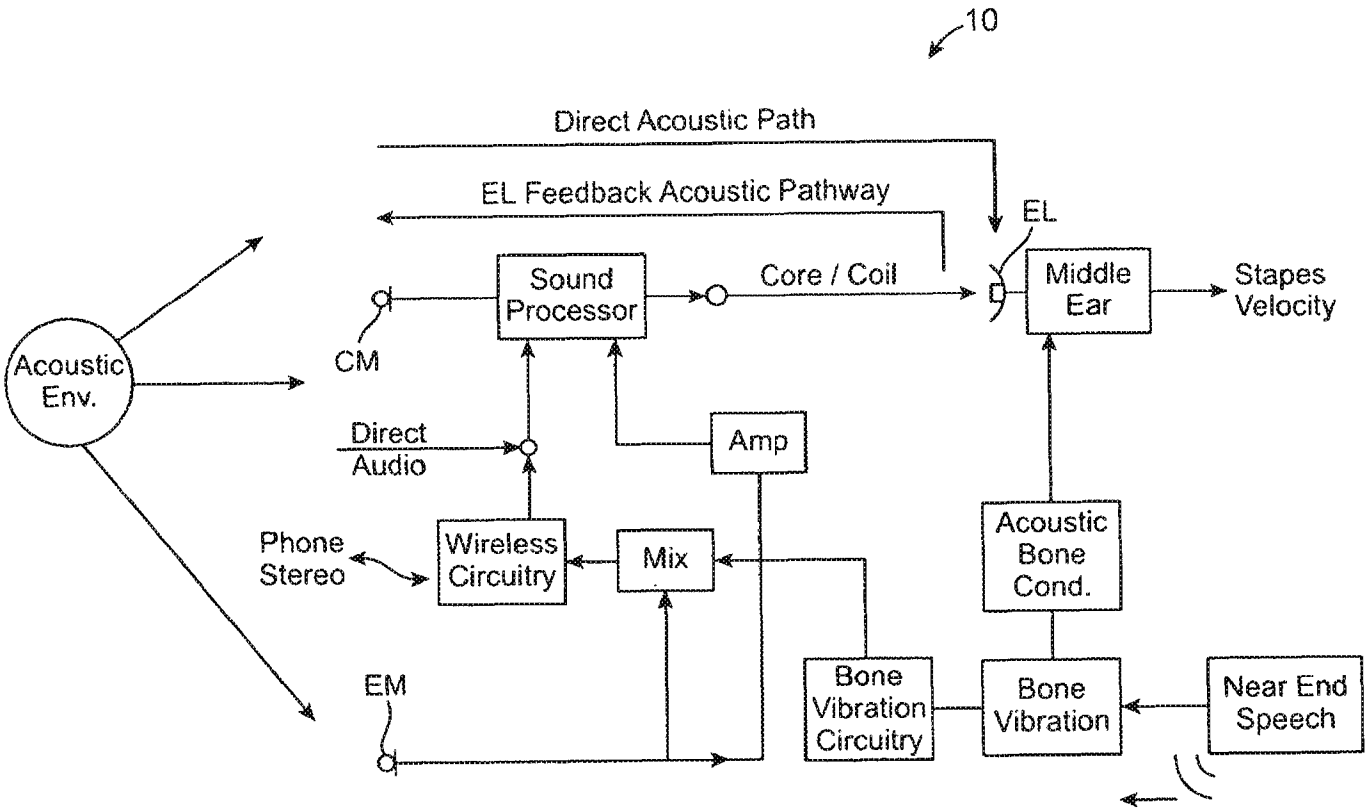
FIG. 1 shows a hearing aid integrated with communication sub-system, noise suppression sub-system and feedback-suppression sub-system, according to embodiments of the present invention.
Figure 10A:
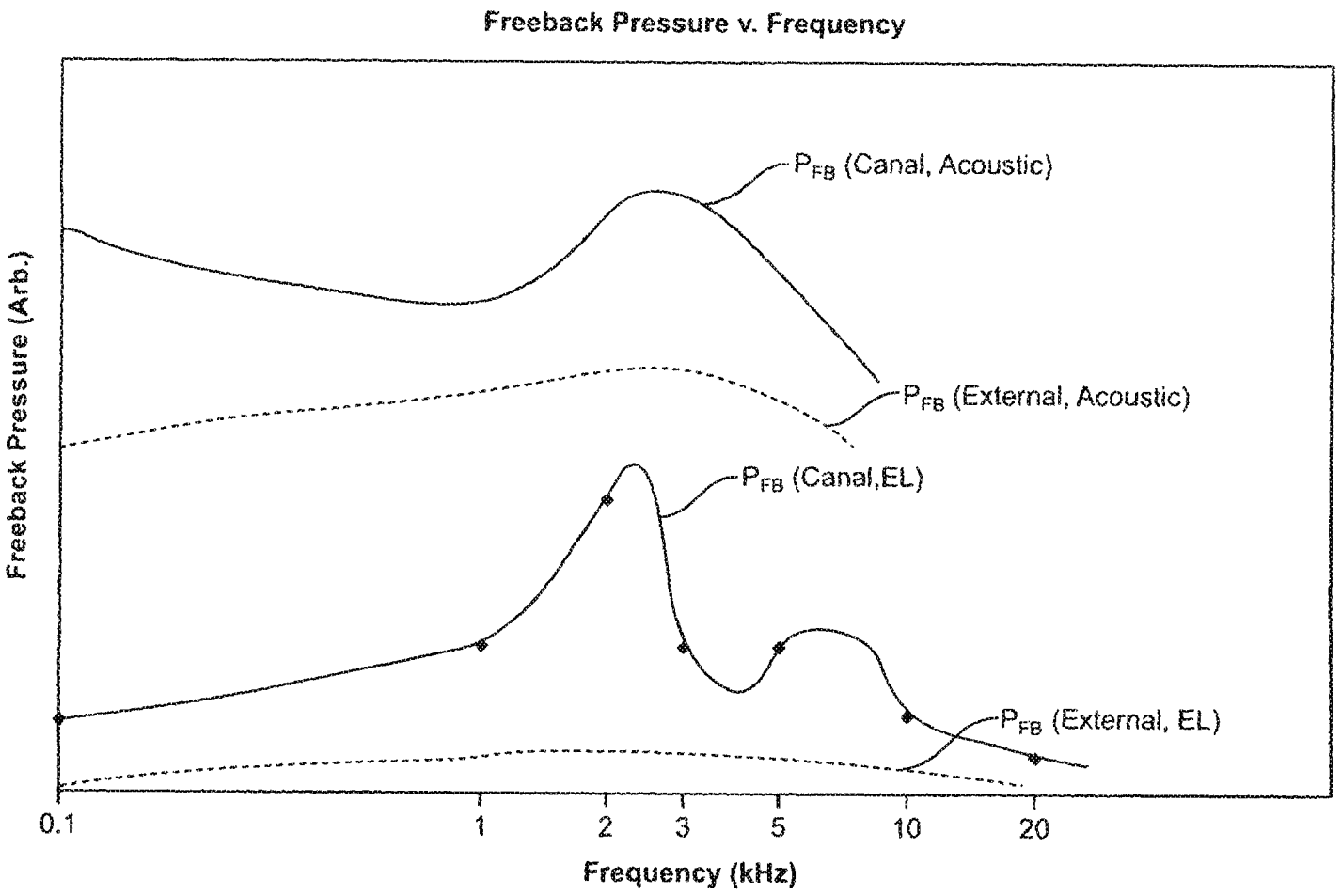
FIG. 10A shows feedback pressure at the canal microphone and feedback pressure at the external microphone for a transducer coupled to the middle ear, according to embodiments of the present invention.
Figure 10B:
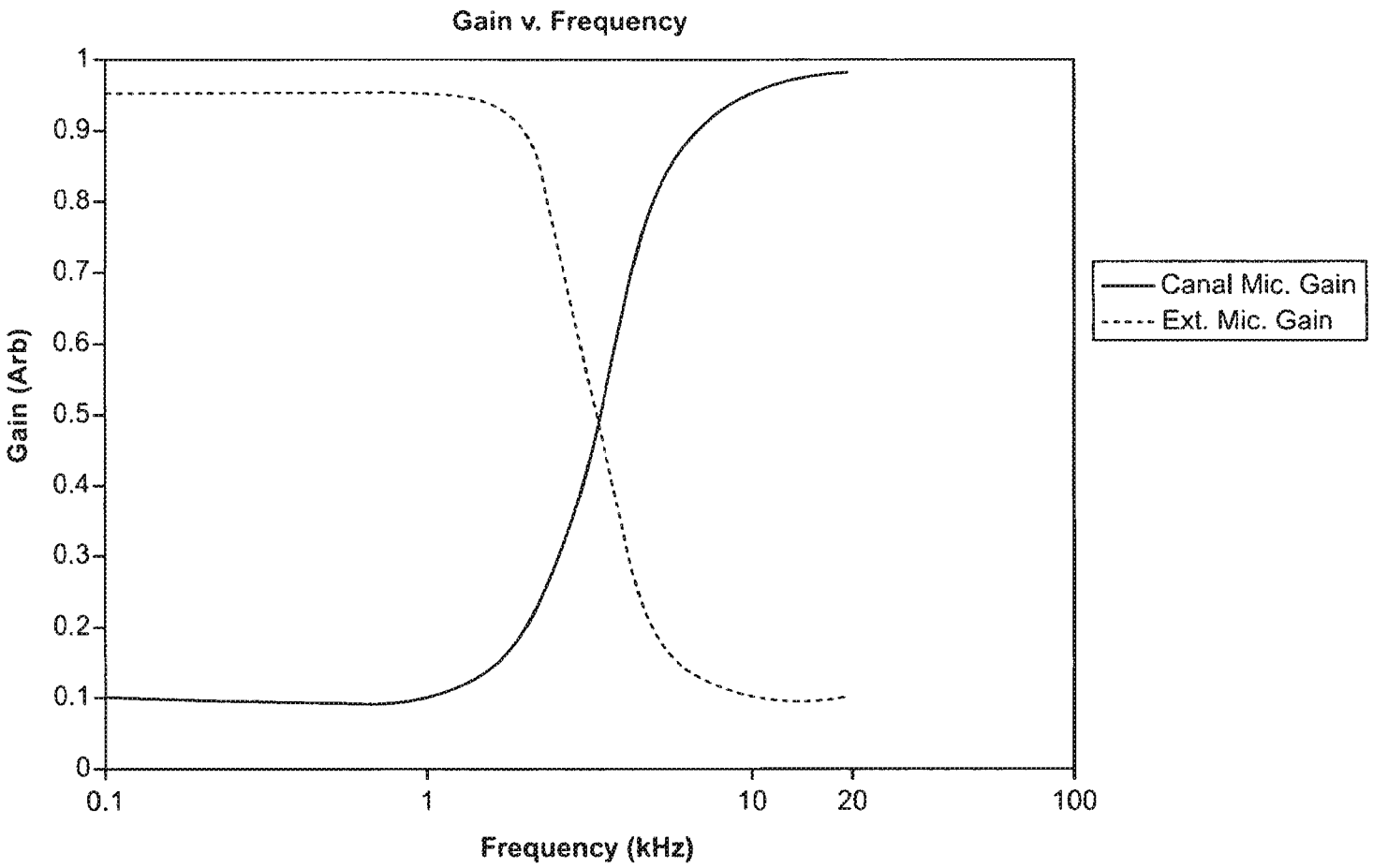
FIG. 10B shows gain versus frequency at the output transducer for sound input to canal microphone and sound input to the external microphone to detect high frequency localization cues and minimize feedback, according to embodiments of the present invention.
Figure 11A:
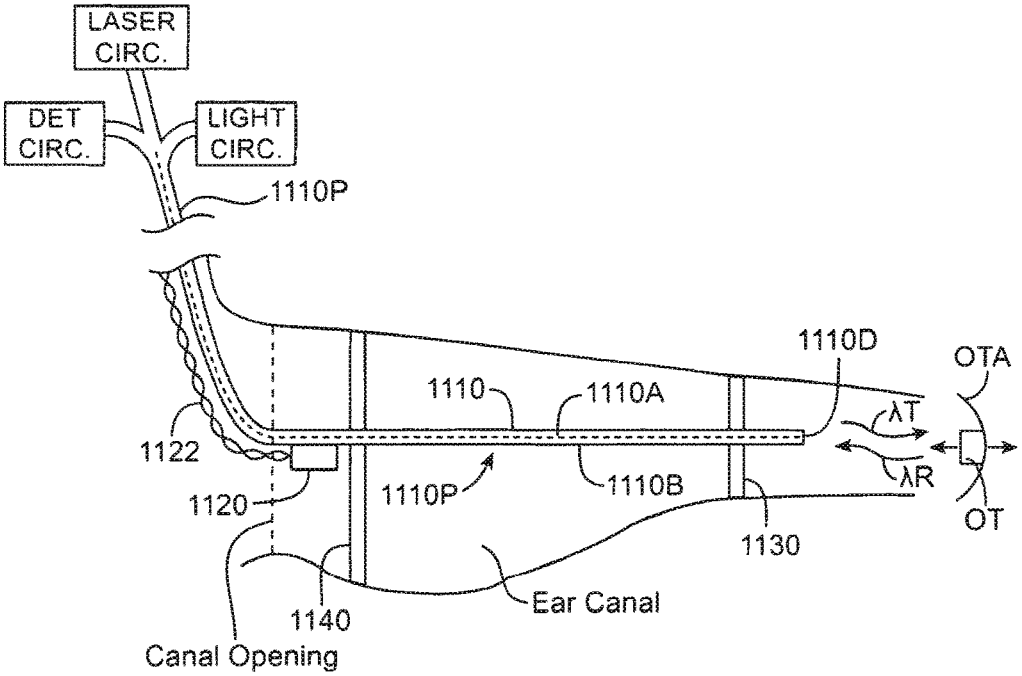
Figure 11B:
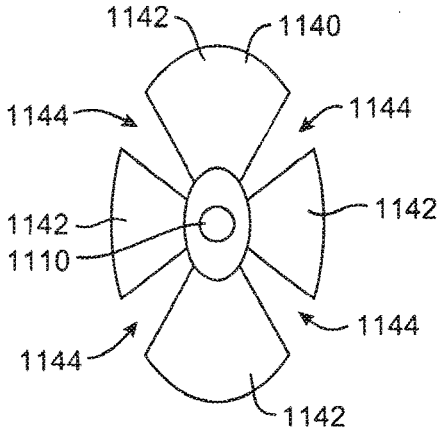
Figure 11C:
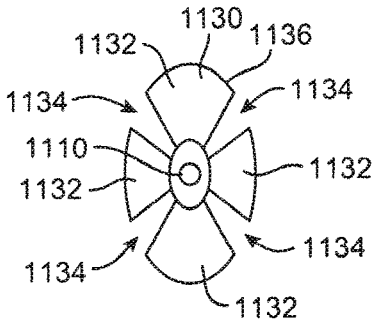

FIG. 10D1 shows a canal microphone coupled to first transducer and an external microphone coupled to a second transducer to provide gain in response to frequency as in FIG. 10B;

FIG. 10D2 shows the canal microphone coupled to a first transducer comprising a first coil wrapped around a core and the external microphone coupled to a second transducer comprising second a coif wrapped around the core, as in FIG. 10D1;

FIG. 11A shows an elongate support comprising a plurality of optical fibers configured to transmit light and receive light to measure displacement of the eardrum, according to embodiments of the present invention;

FIG. 11B shows a positioner for use with an elongate support as in FIG. 11A and adapted for placement near the opening to the ear canal, according to embodiments of the present invention; and FIG. 11C shows a positioner adapted for placement near a distal end of the elongate support as in FIG. 11A, according to embodiments of the present invention.

DETAILED DESCRIPTION OF THE INVENTION

Embodiments of the present invention provide a multifunction audio system integrated with communication system, noise cancellation, and feedback management, and non-surgical transduction. A multifunction hearing aid integrated with communication system, noise cancellation, and feedback management system with an open ear canal is described, which provides many benefits to the user.

FIGS. 1A to 6A illustrate different functionalities embodied in the integrated system. The present multifunction hearing aid comprises with wide bandwidth, sound localization capabilities, as well as communication and noise-suppression capabilities. The configurations for system 10 include configurations for multiple sensor inputs and direct drive of the middle ear.

FIG. 1 shows a hearing aid system 10 integrated with communication sub-system, noise suppression sub-system and feedback-suppression sub-system. System 10 is configured to receive sound input from an acoustic environment. System 10 comprises a canal microphone CM configured to receive input from the acoustic environment, and an external microphone configured to receive input from the acoustic environment. When the canal microphone is placed in the ear canal, the canal microphone can receive high frequency localization cues, similar to natural hearing, that help the user localize sound. System 10 includes a direct audio input, for example an analog audio input from a jack, such that the user can listen to sound from the direct audio input. System 10 also includes wireless circuitry, for example known short range wireless radio circuitry configured to connect with the BLUETOOTH™ short range wireless connectivity standard. The wireless circuitry can receive input wirelessly, such as input from a phone, input from a stereo, and combinations thereof. The wireless circuitry is also coupled to the external microphone EM and bone vibration circuitry, to detect near-end speech when the user speaks. The bone vibration circuitry may comprise known circuitry to detect near-end speech, for example known JAWBONE™ circuitry that is coupled to the skin of the user to detect bone vibration in response to near-end speech. Near end speech can also be transmitted to the middle ear and cochlea, for example with acoustic bone conduction, such that the user can hear him or her self speak.

System 10 comprises a sound processor. The sound processor is coupled to the canal microphone CM to receive input from the canal microphone. The sound processor is coupled to the external microphone EM to receive sound input from the external microphone. An amplifier can be coupled to the external microphone EM and the sound processor so as to amplify sound from the external microphone to the sound processor. The sound processor is also coupled to the direct audio input. The sound processor is coupled to an output transducer configured to vibrate the middle ear. The output transducer may be coupled to an amplifier. Vibration of the middle ear can induce the stapes of the ear to vibrate, for example with velocity, such that the user perceives sound. The output transducer may comprise, for example, the EARLENS™ transducer described by Perkins et al in the following US Patents and Application Publications: 5,259,032; 20060023908; 20070100197, the full disclosures of which are incorporated herein by reference and may include subject matter suitable for combination in accordance with some embodiments of the present invention. The EARLENS™ transducer may have significant advantages due to reduced feedback that can be limited to a narrow frequency range. The output transducer may comprise an output transducer directly coupled to the middle ear, so as to reduce feedback. For example, the EARLENS™ transducer can be coupled to the middle ear, so as to vibrate the middle ear such that the user perceives sound. The output transducer of the EARLENS™ can comprise, for example a core/coil coupled to a magnet. When current is passed through the coil, a magnetic field is generated, which magnetic field vibrates the magnet of the EARLENS™ supported on the eardrum such that the user perceives sound. Alternatively or in combination, the output transducer may comprise other types of transducers, for example, many of the optical transducers or transducer systems described herein.

System 10 is configured tin an open ear canal, such that there is a direct acoustic path from the acoustic environment to the eardrum of the user. The direct acoustic path can be helpful to minimize occlusion of the ear canal, which can result in the user perceiving his or her own voice with a hollow sound when the user speaks. With the open canal configuration, a feedback path can exist from the eardrum to the canal microphone, for example the EL Feedback Acoustic Pathway. Although use of a direct drive transducer such as the coil and magnet of the EARLENS™ system can substantially minimize feedback, it can be beneficial to minimize feedback with additional structures and configurations of system 10.

Figure 1A:
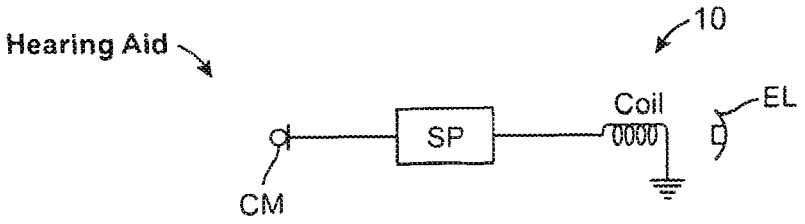
FIG. 1A shows (1) a wide bandwidth EARLENS™ hearing aid of the prior art suitable for use with a mode of the system as in FIG. 1 with an ear canal microphone for sound localization.

FIG. 1A shows (1) a wide bandwidth EARLENS™ hearing aid of the prior art suitable for use with a mode of the system as in FIG. 1 with ear canal microphone CM for sound localization. The canal microphone CM is coupled to sound processor SP. Sound processor SP is coupled to an output amplifier, which amplifier is coupled to a coil to drive the magnet of the EARLENS™ EL.

Figure 2A:
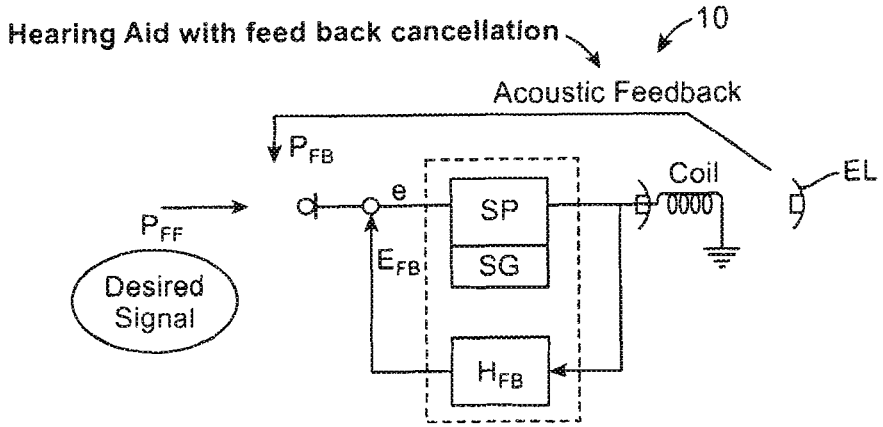
FIG. 2A shows (2) a hearing aide mode of the system as in FIGS. 1 and 1A with feedback cancellation.

FIG. 2A shows (2) a hearing aide mode of the system as in FIGS. 1 and 1A with a feedback cancellation mode. A free field sound pressure $P_{FF}$ may comprise a desired signal. The desired signal comprising the free field sound pressure is incident the external microphone and on the pinna of the ear. The free field sound is diffracted by the pinna of the ear and transformed to form sound with high frequency localization cues at canal microphone CM. As the canal microphone is placed in the ear canal along the sound path between the free field and the eardrum, the canal transfer function $H_C$ may comprise a first component $H_{C1}$ and a second component $H_{C2}$, in which $H_{C1}$ corresponds to sound travel between the free field and the canal microphone and $H_{C2}$ corresponds to sound travel between the canal microphone and the eardrum.

As noted above, acoustic feedback can travel from the EARLENS™ EL to the canal microphone CM. The acoustic feedback travels along the acoustic feedback path to the canal microphone CM, such that a feedback sound pressure $P_{FB}$ is incident on canal microphone CM. The canal microphone CM senses sound pressure from the desired signal $P_{CM}$ and the feedback sound pressure $P_{FB}$. The feedback sound pressure $P_{FB}$ can be canceled by generating an error signal $E_{FB}$. A feedback transfer function $H_{FB}$ is shown from the output of the sound processor to the input to the sound processor, and an error signal e is shown as input to the sound processor. Sound processor SP may comprise a signal generator SG. $H_{FB}$ can be estimated by generating a wide band signal with signal generator SG and nulling out the error signal e. $H_{FB}$ can be used to generate an error signal $E_{FB}$ with known signal processing techniques for feedback cancellation. The feedback suppression may comprise or be combined with known feedback suppression methods, and the noise cancellation may comprise or be combined with known noise cancellation methods.

Figure 3A:
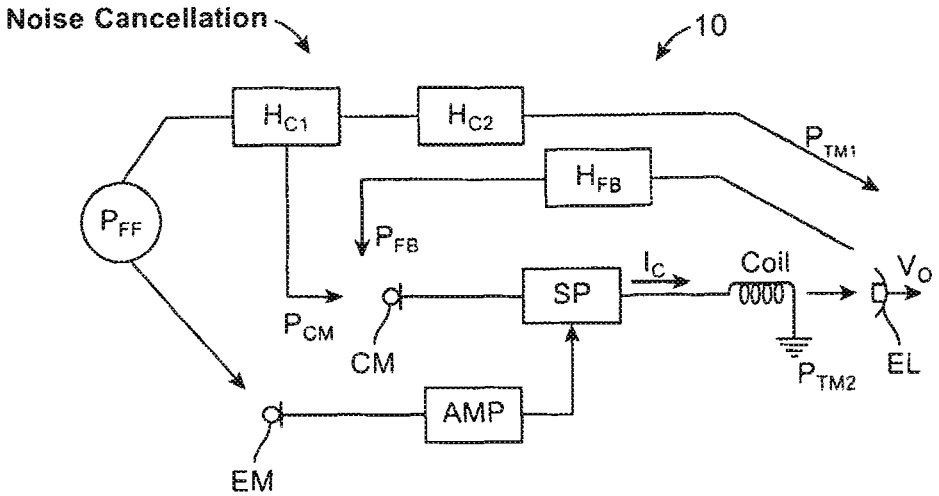
FIG. 3A shows (3) a hearing aid mode of the system as in FIGS. 1 and 1A operating with noise cancellation.

FIG. 3A shows (3) a hearing aid mode of the system as in FIGS. 1 and 1A operating with a noise cancellation mode. The external microphone EM is coupled to the sound processor SP, through an amplifier AMP. The canal microphone CM is coupled to the sound processor SP. External microphone EM is configured to detect sound from free field sound pressure $P_{FF}$. Canal microphone CM is configured to detect sound from canal sound pressure $P_{CM}$. The sound pressure $P_{FF}$ travels through the ear canal and arrives at the tympanic membrane to generate a pressure at the tympanic membrane $P_{TM2}$. The free field sound pressure $P_{FF}$ travels through the ear canal in response to au ear canal transfer function $H_C$ to generate a pressure at the tympanic membrane $P_{TM1}$. The system is configured to minimize $V_0$ corresponding to vibration of the eardrum due to $P_{FF}$. The output transducer is configured to vibrate with—$P_{TM1}$ such that $V_0$ corresponding to vibration of the eardrum is minimized, and thus $P_{FB}$ at the canal microphone may also be minimized. The transfer function of the ear canal $H_{C1}$ can be determined in response to $P_{CM}$ and $P_{FF}$, for example in response to the ratio of $P_{CM}$ to $P_{FF}$ with the equation $H_{C1}=P_{CM}/P_{FF}$.

The sound processor can be configured to pass an output current $I_C$ through the coil which minimizes motion of the eardrum. The current through the coil for a desired. $P_{TM2}$ can be determined with the following equation and approximation:

$$I_C=P_{TM1}/P_{TM2}(P_{TM1}/P_{EFF})mA$$

where $P_{EFF}$ comprises the effective pressure at the tympanic membrane per milliamp of the current measured on an individual subject.

The ear canal transfer function $H_C$ may comprise a first ear canal transfer function $H_{C1}$ and a second ear canal transfer function $H_{C2}$. As the canal microphone CM is placed in the ear canal, the second car canal transfer function $H_{C2}$ may correspond to a distance along the ear canal from ear canal microphone CM to the eardrum. The first ear canal transfer function $H_{C1}$ may correspond to a portion of the ear canal from the ear canal microphone CM to the opening of the ear canal. The first ear canal transfer function may also comprise a pinna transfer function, such that first ear canal transfer function $H_{C1}$ corresponds to the ear canal sound pressure $P_{CM}$ at the canal microphone in response to the free field sound pressure $P_{CM}$ after the free field sound pressure has been diffracted by the pinna so as to provide sound localization cues near the entrance to the ear canal.

The above described noise cancellation and feedback suppression can be combined in many ways. For example, the noise cancellation can be used with an input, for example direct audio input during a flight white the user listens to a movie, and the surrounding noise of the flight cancelled with the noise cancellation from the external microphone, and the sound processor configured to transmit the direct audio to the transducer, for example adjusted to the user's hearing profile, such that the user can hear the sound, for example from the movie, clearly.

Figure 4A:
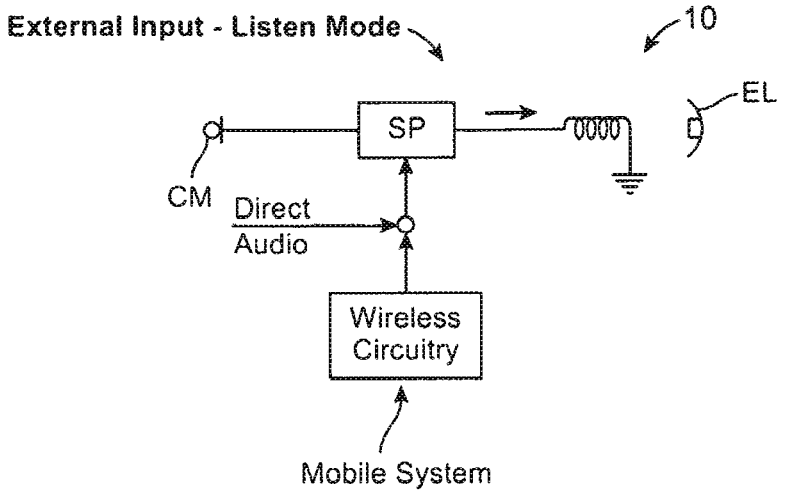
FIG. 4A shows (4) the system as in FIG. 1 where the audio input is from an RF receiver, for example a BLUETOOTH™ device connected to the far-end speech of the communication channel of a mobile phone.

FIG. 4A shows (4) the system as in FIG. 1 where the audio input is from an RF receiver, for example a BLUETOOTH™ device connected to the far-end speech of the communication channel of a mobile phone. The mobile system may comprise a mobile phone system, tier example a far end mobile phone system. The system 10 may comprise a listen mode to listen to an external input. The external input in the listen mode may comprise at least one of a) the direct audio input signal or b) far-end speech from the mobile system.

Figure 5A:
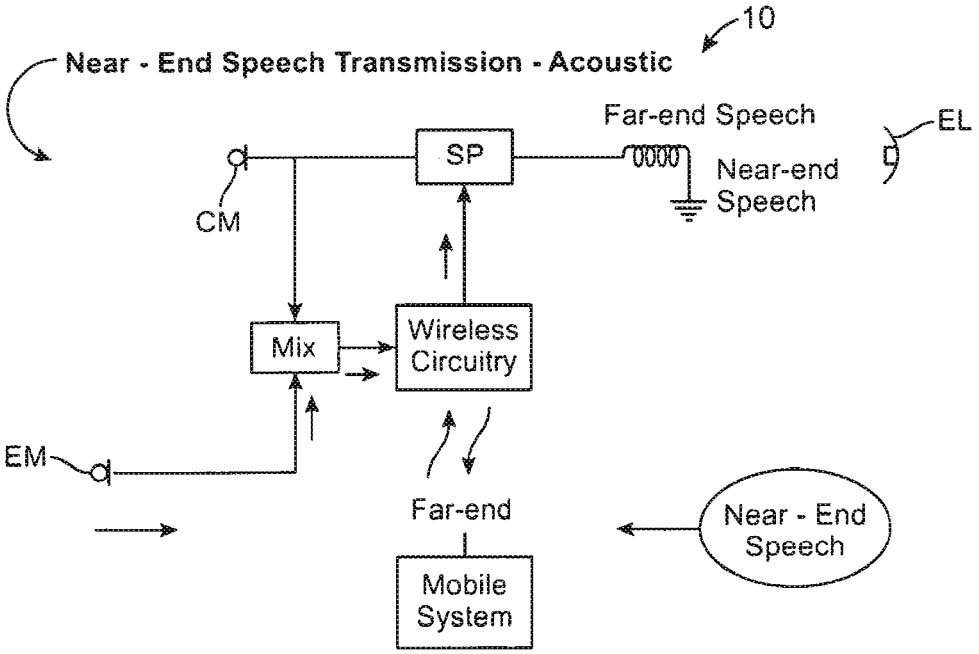
FIG. 5A shows (5) the system as in FIGS. 1 and 4A configured to transmit the near-end speech, in which the speech can be a mix of the signal generated by the external microphone and the ear canal microphone from sensors including a small vibration sensor.

FIG. 5A shows (5) the system as in FIGS. 1, 1A and 4A configured to transmit the near-end speech with an acoustic mode. The acoustic signal may comprise near end speech detected with a microphone, for example. The near-end speech can be a mix of the signal generated by the external microphone and the mobile phone microphone. The external microphone EM is coupled to a mixer. The canal microphone may also be coupled to the mixer. The mixer is coupled to the wireless circuitry to transmit the near-end speech to the far-end. The user is able to hear both near end speech and far end speech.

Figure 6A:
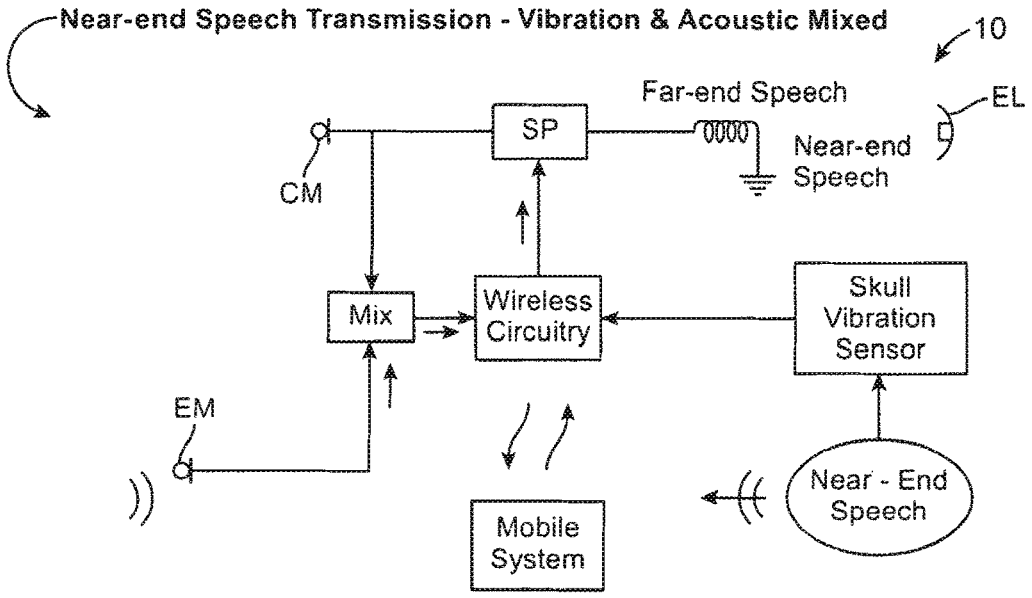
FIG. 6A shows the system as in FIGS. 1, 1A, 4A and 5A configured to transduce and transmit the near-end speech, from a noisy environment, to the far-end listener.

FIG. 6A shows the system as in FIGS. 1, 1A, 4A and 5A configured to transduce and transmit the near-end speech from a noisy environment to the far-end listener. The system 10 comprises a near-end speech transmission with a mode configured for vibration and acoustic detection of near end speech. The acoustic detection comprises the canal microphone CM and the external microphone EM mixed with the mixer and coupled to the wireless circuitry. The near end speech also induces vibrations in the user's bone, for example the user's skull, that can be detected with a vibration sensor. The vibration sensor may comprise a commercially available vibration sensor such as components of the JAWBONE™. The skull vibration sensor is coupled to the wireless circuitry. The near-end sound vibration detected from the bone conduction vibration sensor is combined with the near-end sound from at least one of the canal microphone CM or the external microphone EM and transmitted to the far-end user of the mobile system.

Figure 7A:
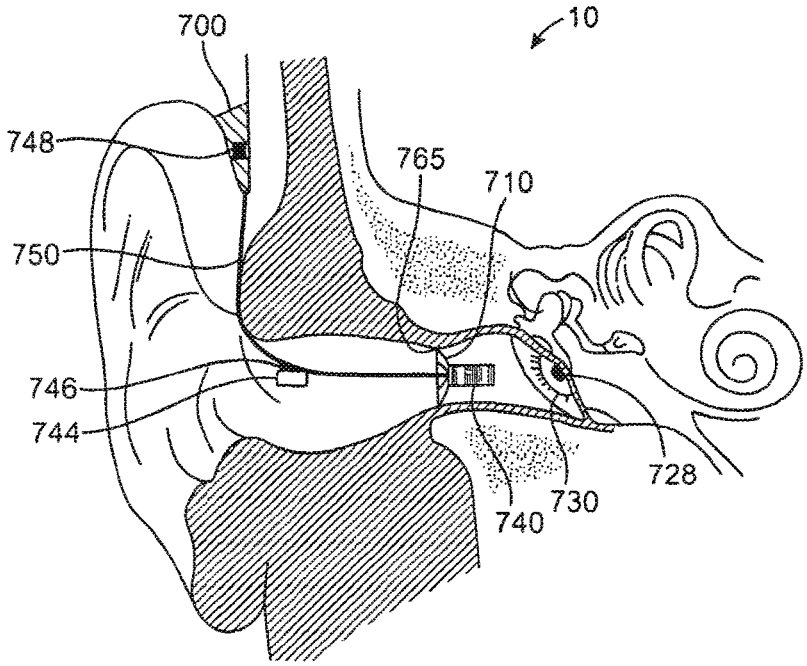
FIG. 7A shows a piezoelectric positioner configured for placement in the ear canal to detect near-end speech, according to embodiments of the present invention.

FIG. 7A shows a piezoelectric positioner 710 configured to detect near end speech of the user. Piezo electric positioner 710 can be attached to an elongate support near a transducer, in which the piezoelectric positioner is adapted to contact the ear in the canal near the transducer and support the transducer. Piezoelectric positioner 710 may comprise a piezoelectric ring 720 configured to detect near-end speech of the user in response to bone vibration when the user speaks. The piezoelectric ring 720 can generate an electrical signal in response to bone vibration transmitted through the skin of the ear canal. A piezo electric positioner 710 comprises a wise support attached to elongate support 750 near coil assembly 740. Piezoelectric positioner 710 can be used to center the coil in the canal to avoid contact with skin 765, and also to maintain a fixed distance between coil assembly 740 and magnet 728. Piezoelectric positioner 710 is adapted for direct contact with a skin 765 of ear canal. For example, piezoelectric positioner 710 includes a width that is approximately the same size as the cross sectional width of the ear canal where the piezoelectric positioner contacts skin 765. Also, the width of piezoelectric positioner 710 is typically greater than a cross-sectional width of coil assembly 740 so that the piezoelectric positioner can suspend coil assembly 740 in the ear canal to avoid contact between coil assembly 40 and skin 765 of the ear canal.

The piezo electric positioner may comprise many known piezoelectric materials, for example at least one of Polyvinylidene Fluoride (PVDF), PVF, or lead zirconatc titanate (PZT).

System 10 may comprise a behind the ear unit, for example BTE unit 700, connected to elongate support 750. The BTE unit 700 may comprise many of the components described above, for example the wireless circuitry, the sound processor, the mixer and a power storage device. The BTE unit 700 may comprise an external microphone 748. A canal microphone 744 can be coupled to the elongate support 750 at a location 746 along elongate support 750 so as to position the canal microphone at least one of inside the near canal or near the ear canal opening to detect high frequency sound localization cues in response to sound diffraction from the Pinna. The canal microphone and the external microphone may also detect head shadowing, for example with frequencies at which the head of the user may cast an acoustic shadow on the microphone 744 and microphone 748.

Positioner 710 is adapted for comfort during insertion into the user's ear and thereafter. Piezoelectric positioner 710 is tapered proximally (and laterally) toward the ear canal opening to facilitate insertion into the ear of the user. Also, piezoelectric positioner 710 has a thickness transverse to its width that is sufficiently thin to permit piezoelectric positioner 710 to flex while the support is inserted into position in the ear canal. However, in some embodiments the piezoelectric positioner has a width that approximates the width of the typical ear canal and a thickness that extends along the car canal about the same distance as coil assembly 740 extends along the ear canal. Thus, as shown in FIG. 7A piezoelectric positioner 710 has a thickness no more than the length of coil assembly 740 along the ear canal.

Positioner 710 permits sound waves to pass and provides and can be used to provide an open canal hearing aid design. Piezoelectric positioner 710 comprises several spokes and openings formed therein. In an alternate embodiment, piezoelectric positioner 710 comprises soft "flower" like arrangement. Piezoelectric positioner 710 is designed to allow acoustic energy to pass, thereby leaving the ear canal mostly open.

Figure 7B:
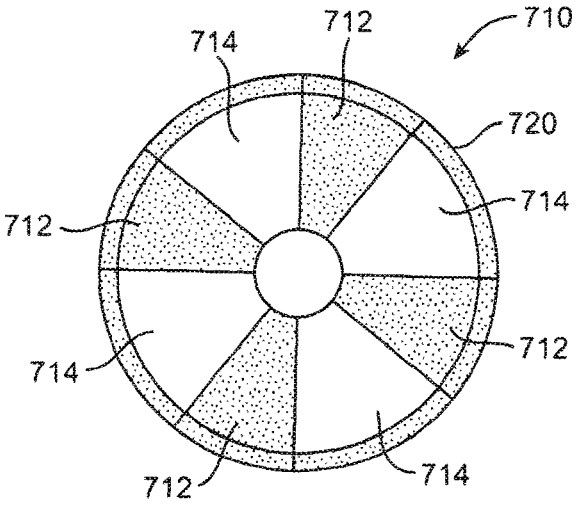
FIG. 7B shows a positioner as in FIG. 7A in detail, according to embodiments of the present invention.

FIG. 7B shows a piezoelectric positioner 710 as in FIG. 7A in detail, according to embodiments of the present invention. Spokes 712 and piezoelectric ring 720 define apertures 714. Apertures 714 are shaped to permit acoustic energy to pass. In an alternate embodiment, the rim is elliptical to better match the shape of the ear canal defined by skin 765. Also, the rim can be removed so that spokes 712 engage the skin in a "flower petal" like arrangement. Although four spokes are shown, any number of spokes can be used. Also, the apertures can be any shape, for example circular, elliptical, square or rectangular.

Figure 8A:
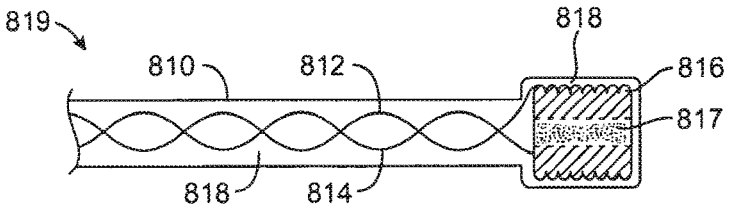
FIG. 8A shows an elongate support with a pair of positioners adapted to contact the ear canal, and in which at least one of the positioners comprises a piezoelectric positioner configured to detect near end speech of the user, according to embodiments of the present invention.

FIG. 8A shows an elongate support with a pair of positioners adapted to contact the ear canal, and in which at least one of the positioners comprises a piezoelectric positioner configured to detect near end speech of the user, according to embodiments of the present invention. An elongate support 810 extends to a coil assembly 819. Coil assembly 819 comprises a coil 816, a core 817 and a biocompatible material 818. Elongate support 810 includes a wire 812 and a wire 814 electrically connected to coil 816. Coil 816 can include any of the coil configurations as described, above. Wire 812 and wire 814 are shown as a twisted pair, although other configurations can be used as described above. Elongate support 810 comprises biocompatible material 818 formed over wire 812 and wire 814. Biocompatible material 818 covers coil 816 and core 817 as described above.

Wire 812 and wire 814 are resilient members and are sized and comprise material selected to elastically flex in response to small deflections and provide support to coil assembly 819. Wire 812 and wire 814 are also sized and comprise material selected to deform in response to large deflections so that elongate support 810 can be deformed to a desired shape that matches the ear canal. Wire 812 and wire 814 comprise metal and are adapted to conduct heat from coil assembly 819. Wire 812 and wire 814 are soldered to coil 816 and can comprise a different gauge of wire from the wire of the coil, in particular a gauge with a range from about 26 to about 36 that is smaller than the gauge of the coil to provide resilient support and heat conduction. Additional heat conducting materials can be used to conduct and transport heat from coil assembly 819, for example shielding positioned around wire 812 and wire 814. Elongate support 810 and wire 812 and wire 814 extend toward the driver unit and are adapted to conduct heat out of the ear canal.

Figure 8B:
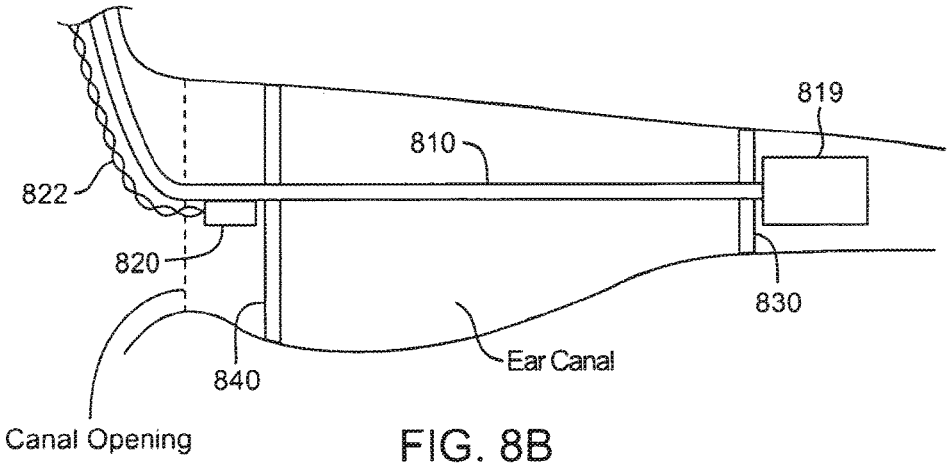
FIG. 8B shows an elongate support as in FIG. 8A attached to two positioners placed in an ear canal, according to embodiments of the present invention.
Figures 1, 8B:
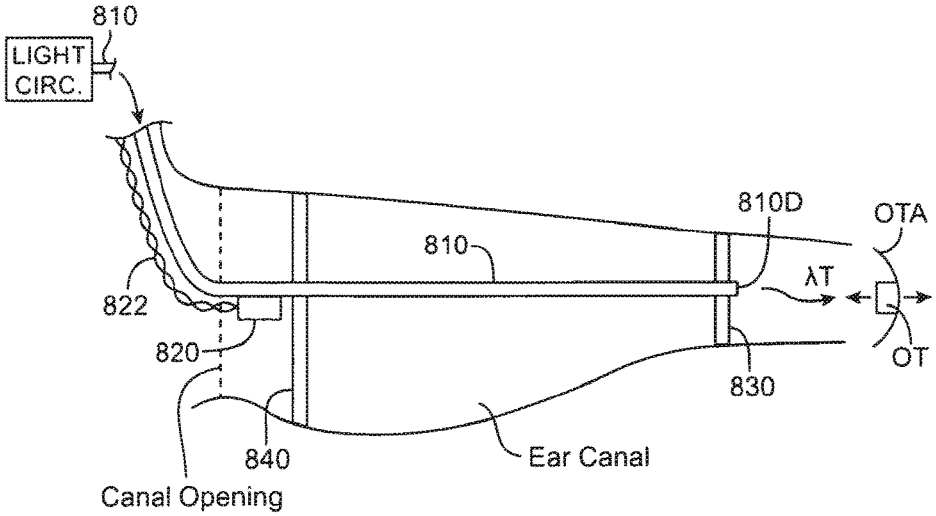

FIG. 8B shows an elongate support as in FIG. 8A attached to two piezoelectric positioners placed in an ear canal, according to embodiments of the present invention. A first piezoelectric positioner 830 is attached to elongate support 810 near coil assembly 819. First piezoelectric positioner 830 engages the skin of the ear canal to support coil assembly 819 and avoid skin contact with the coil assembly. A second piezoelectric positioner 840 is attached to elongate support 810 near ear canal opening 817. In some embodiments, microphone 820 may be positioned slightly outside the ear canal and near the canal opening so as to detect high frequency localization cues, for example within about 7 mm of the canal opening. Second piezoelectric positioner 840 is sized to contact the skin of the ear canal near opening 17 to support elongate support 810. A canal microphone 820 is attached to elongate support 810 near ear canal opening 17 to detect high frequency sound localization cues. The piezoelectric positioners and elongate support are sized and shaped so that the supports substantially avoid contact with the ear between the microphone and the coil assembly. A twisted pair of wires 822 extends from canal microphone 820 to the driver unit and transmits an electronic auditory signal to the driver unit. Alternatively, other modes of signal transmission, as described below with reference to FIG. 8B-1, may be used. Although canal microphone 820 is shown lateral to piezoelectric positioner 840, microphone 840 can be positioned medial to piezoelectric positioner 840. Elongate support 810 is resilient and deformable as described above. Although elongate support 810, piezoelectric positioner 830 and piezoelectric positioner 840 are shown as separate structures, the support can be formed from a single piece of material, for example a single piece of material formed with a mold. In some embodiments, elongate support 81, piezoelectric positioner 830 and piezoelectric positioner 840 are each formed as separate pieces and assembled. For example, the piezoelectric positioners can be formed with holes adapted to receive the elongate support so that the piezoelectric positioners can be slid into position on the elongate support.

Figure 8C:
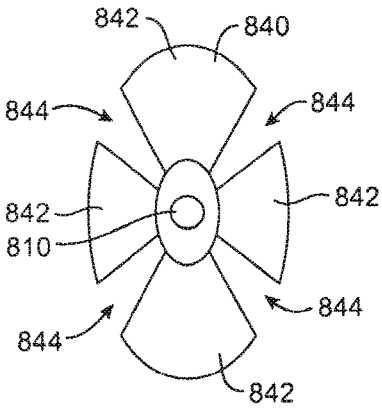
FIG. 8C shows a positioner adapted for placement near the opening to the ear canal, according to embodiments of the present invention.

FIG. 8C shows a piezoelectric positioner adapted for placement near the opening to the car canal according to embodiments of the present invention. Piezoelectric positioner 840 includes piezoelectric flanges 842 that extend radially outward to engage the skin of the ear canal. Flanges 842 are formed from a flexible material. Openings 844 are defined by piezoelectric flanges 842. Openings 844 permit sound waves to pass piezoelectric positioner 840 while the piezoelectric positioner is positioned in the ear canal, so that the sound waves are transmitted to the tympanic membrane. Although piezoelectric flanges 842 define an outer boundary of support 840 with an elliptical shape, piezoelectric flanges 842 can comprise an outer boundary with any shape, for example circular. In some embodiments, the piezoelectric positioner has an outer boundary defined by the shape of the individual user's ear canal, for example embodiments where piezoelectric positioner 840 is made from a mold of the user's ear. Elongate support 810 extends transversely through piezoelectric positioner 840.

Figure 8D:
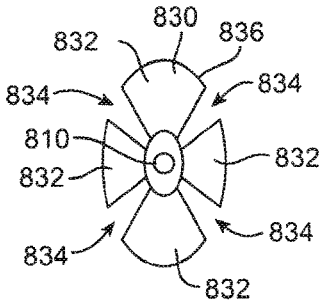
FIG. 8D shows a positioner adapted for placement near the coil assembly, according to embodiments of the present invention.

FIG. 8D shows a piezoelectric positioner adapted for placement near the coil assembly, according to embodiments of the present invention. Piezoelectric positioner 830 includes piezoelectric flanges 832 that extend radially outward to engage the skin of the ear canal. Flanges 832 are formed from a flexible piezoelectric material, for example a biomorph material. Openings 834 are defined by piezoelectric flanges 832. Openings 831 permit sound waves to pass piezoelectric positioner 830 while the piezoelectric positioner is positioned in the ear canal, so that the sound waves are transmitted to the tympanic membrane. Although piezoelectric flanges 832 define an outer boundary of support 830 with an elliptical shape, piezoelectric flanges 832 can comprise an outer boundary with any shape, for example circular. In some embodiments, the piezoelectric positioner has an outer boundary defined by the shape of the individual user's ear canal, for example embodiments where piezoelectric positioner 830 is made from a mold of the user's car. Elongate support 810 extends transversely through piezoelectric positioner 830.

Although an electromagnetic transducer comprising coil 819 is shown positioned on the end of elongate support 810, the piezoelectric positioner and elongate support can be used with many types of transducers positioned at many locations, for example optical electromagnetic transducers positioned outside the ear canal and coupled to the support to deliver optical energy along the support, for example through at least one optical fiber. The at least one optical fiber may comprise a single optical fiber or a plurality of two or more optical fibers of the support. The plurality of optical fibers may comprise a parallel configuration of optical fibers configured to transmit at least two channels in parallel along the support toward the eardrum of the user.

FIG. 8B-1 shows an elongate support configured to position a distal end of the elongate support with at least one piezoelectric positioner placed in an ear canal. Elongate support 810 and at least one piezoelectric positioner, for example at least one of piezoelectric positioner 830 or piezoelectric positioner 840, or both, are configured to position support 810 in the car canal with the electromagnetic energy transducer positioned outside the ear canal, and the microphone positioned at least one of in the car canal or near the car canal opening so as to detect high frequency spatial localization clues, as described above. For example, the output energy transducer, or emitter, may comprise a light source configured to emit electromagnetic energy comprising optical frequencies, and the light source can be positioned outside the ear canal, for example in a BTE unit. The light source may comprise at least one of an LED or a laser diode, for example. The light source, also referred to as an emitter, can emit visible light, or infrared light, or a combination thereof. Light circuitry may comprise the light source and can be coupled to the output of the sound processor to emit a light signal to an output transducer placed on the eardrum so as to vibrate the eardrum such that the user perceives sound. The light source can be coupled to the distal end of the support 810 with a waveguide, such as an optical fiber with a distal end of the optical fiber 810D comprising a distal end of the support. The optical energy delivery transducer can be coupled to the proximal portion of the elongate support to transmit optical energy to the distal end. The piezoelectric positioner can be adapted to position the distal end of the support near an eardrum when the proximal portion is placed at a location near an ear canal opening. The intermediate portion of elongate support 810 can be sized to minimize contact with a canal of the ear between the proximal portion to the distal end.

The at least one piezoelectric positioner, for example piezoelectric positioner 830, can improve optical coupling between the light source and a device positioned on the eardrum, so as to increase the efficiency of light energy transfer from the output energy transducer, or emitter, to an optical device positioned CM the eardrum. For example, by improving alignment of the distal end 810D of the support that emits light and a transducer positioned at least one of on the eardrum or inside the middle ear, for example positioned on an ossicle of the middle ear. The device positioned on the eardrum may comprise an optical transducer assembly OTA. The optical transducer assembly OTA may comprise a support configured for placement on the eardrum, for example molded to the eardrum and similar to the support used with transducer EL. The optical transducer assembly OTA may comprise an optical transducer configured to vibrate in response to transmitted light $\lambda_T$. The transmitted light $\lambda_T$ may comprise many wavelengths of light, for example at least one of visible light or infrared light, or a combination thereof. The optical transducer assembly OTA vibrates on the eardrum in response to transmitted light $\lambda_T$ The at least one piezoelectric positioner and elongate support 810 comprising an optical fiber can be combined with many known optical transducer and hearing devices, for example as described in U.S. U.S. 2006/0189841, entitled "Systems and Methods for Photo-Mechanical Hearing Transduction"; and U.S. Pat. No. 7,289,639, entitled "Hearing Implant", the full disclosure of which are incorporated herein by reference and may include subject matter suitable for combination in accordance with some embodiments of the present invention. The piezoelectric positioner and elongate support may also be combined with photo-electro-mechanical transducers positioned on the ear drum with a support, as described in U.S. Pat. Ser. Nos. 61/073,271; and 61/073,281, both filed on Jun. 17, 2008, the fill disclosure of which are incorporated herein by reference and may include subject matter suitable for combination in accordance with some embodiments of the present invention.

In specific embodiments, elongate support 810 may comprise an optical fiber coupled to piezoelectric positioner 830 to align the distal end of the optical fiber with an output transducer assembly supported on the eardrum. The output transducer assembly may comprise a photodiode configured to receive light transmitted from the distal end of support 810 and supported with support component 30 placed on the eardrum, as described above. The output transducer assembly can be separated from the distal end of the optical fiber, and the proximal end of the optical fiber can be positioned in the BTE unit and coupled to the light source. The output transducer assembly can be similar to the output transducer assembly described in U.S. 2006/0189841, with piezoelectric positioner 830 used to align the optical fiber with the output transducer assembly, and the BTE unit may comprise a housing with the light source positioned therein.

Figure 9:
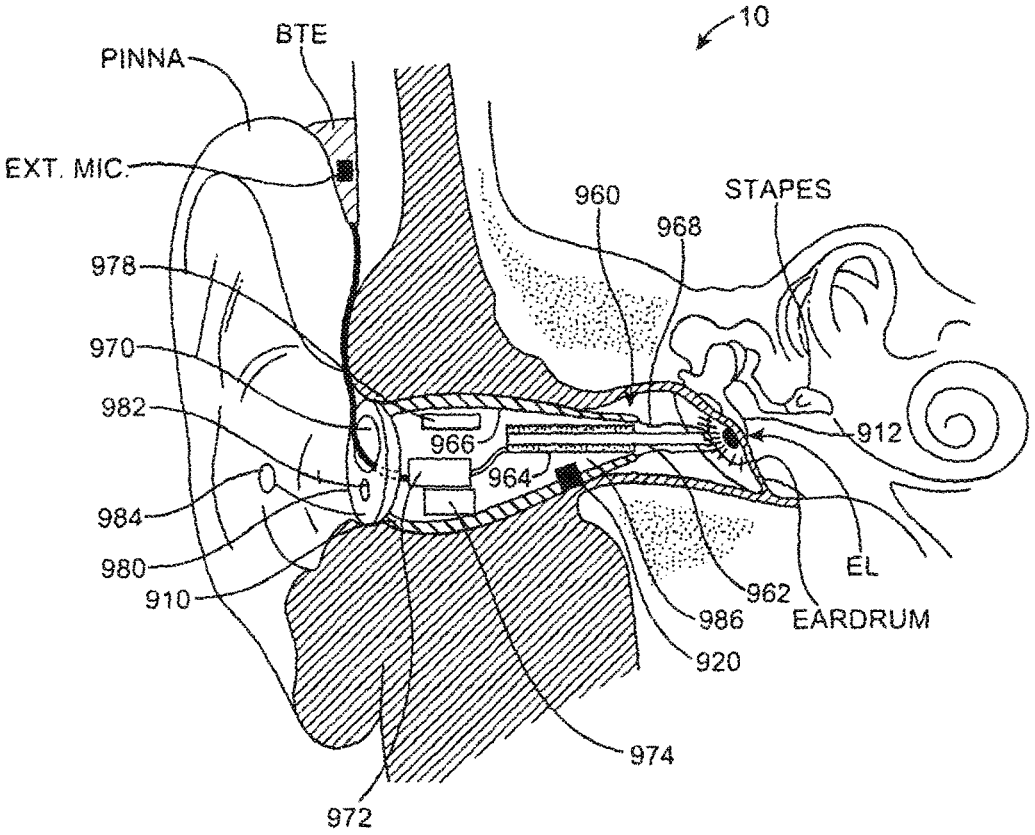
FIG. 9 illustrates a body comprising the canal microphone installed in the ear canal and coupled to a BTL unit comprising the external microphone, according to embodiments of the present invention.

FIG. 9 illustrates a body 910 comprising the canal microphone installed in the ear canal and coupled to a BTE unit comprising the external microphone, according to embodiments of system 10. The body 910 comprises the transmitter installed in the ear canal coupled to the BTE unit. The transducer comprises the EARLENS™ installed on the tympanic membrane. The transmitter assembly 960 is shown with shell 966 cross-sectioned. The body 910 comprising shell 966 is shown installed in a right ear canal and oriented with respect to the transducer EL. The transducer assembly EL is positioned against tympanic membrane, or eardrum at umbo area 912. The transducer may also be placed on other acoustic members of the middle ear, including locations on the malleus, incus, and stapes. When placed in the umbo area 912 of the eardrum, the transducer EL will be naturally tilted with respect to the ear canal. The degree of nit will vary from individual to individual, but is typically at about a 60-degree angle with respect to the ear canal. Many of the components of the shell and transducer can be similar to those described in U.S. Pub, No. 2006/0023908, the full disclosure of which has been previously incorporated herein by reference and may include subject matter suitable for combination in accordance with some embodiments of the present invention.

A first microphone for high frequency sound localization, for example canal microphone 974, is positioned inside the ear canal to detect high frequency localization cues. A BTE unit is coupled to the body 910. The BTE unit has a second microphone, for example an external microphone positioned on the BTE unit to receive external sounds. The external microphone can be used to detect low frequencies and combined with the high frequency microphone input to minimize feedback when high frequency sound is detected with the high frequency microphone, for example canal microphone 974. A bone vibration sensor 920 is supported with shell 966 to detect bone conduction vibration when the user speaks. An outer surface of bone vibration sensor 920 can be disposed along outer surface of shell 966 so as to contact tissue of the ear canal, for example substantially similar to an outer surface of shell 966 near the sensor to minimize tissue irritation. Bone vibration sensor 920 may also extend through an outer surface shell 966 to contact the tissue of the ear canal. Additional components of system 10, such as wireless communication circuitry and the direct audio input, as described above, can be located in the BTE unit. The sound processor may be located in many places, for example in the BTE unit or within the ear canal.

The transmitter assembly 960 has shell 966 configured to mate with the characteristics of the individual's ear canal wall. Shell 966 can be preferably matched to fit snug in the individual's ear canal so that the transmitter assembly 960 may repeatedly be inserted or removed from the ear canal and still be properly aligned when re-inserted in the individual's ear. Shell 966 can also be configured to support coil 964 and core 962 such that the tip of core 962 is positioned at a proper distance and orientation in relation to the transducer 926 when the transmitter assembly is properly installed in the ear canal. The core 962 generally comprises ferrite, but may be any material with high magnetic permeability.

In many embodiments, coil 964 is wrapped around the circumference of the core 962 along part or all of the length of the core. Generally, the coil has a sufficient number of rotations to optimally drive an electromagnetic field toward the transducer. The number of rotations may vary depending on the diameter of the coil, the diameter of the core, the length of the core, and the overall acceptable diameter of the coil and core assembly based on the size of the individual's ear canal. Generally, the force applied by the magnetic field on the magnet will increase, and therefore increase the efficiency of the system, with an increase in the diameter of the core. These parameters will be constrained, however, by the anatomical limitations of the individual's ear. The coil 964 may be wrapped around only a portion of the length of the core allowing the tip of the core to extend further into the ear canal.

One method for matching the shell 966 to the internal dimensions of the ear canal is to make art impression of the ear canal cavity, including the tympanic membrane. A positive investment is then made from the negative impression. The outer surface of the shell is then formed from the positive investment which replicated the external surface of the impression. The coil 964 and core 962 assembly can then be positioned and mounted in the shell 966 according to the desired orientation with respect to the projected placement of the transducer 926, which may be determined from the positive investment of the ear canal and tympanic membrane. Other methods of matching the shell to the ear canal of the user, such as imaging of the user may be used.

Transmitter assembly 960 may also comprise a digital signal processing (DSP) unit 972, microphone 974, and battery 978 that are supported with body 910 and disposed inside shell 966. A BTE unit may also be coupled to the transmitter assembly, and at least some of the components, such as the DSP unit can be located in the BTE unit. The proximal end of the shell 966 has a faceplate 980 that can be temporarily removed to provide access to the open chamber 986 of the shell 966 and transmitter assembly components contained therein. For example, the faceplate 980 may be removed to switch out battery 978 or adjust the position or orientation of core 962. Faceplate 980 may also have a microphone port 982 to allow sound to be directed to microphone 974. Pull line 984 may also be incorporated into the shell 966 of faceplate 980 so that the transmitter assembly can be readily removed from the ear canal. In some embodiments, the external microphone may be positioned outside the ear near a distal end of pull line 984, such that the external microphone is sufficiently far from the car canal opening so as to minimized feedback from the external microphone.

In operation, ambient sound entering the pinna, or auricle, and ear canal is captured by the microphone 974, which converts sound waves into analog electrical signals for processing by the DSP unit 972. The DSP unit 972 may be coupled to an input amplifier to amplify the signal and convert the analog signal to a digital signal with a analog to digital converter commonly used in the art. The digital signal can then be processed by any number of known digital signal processors. The processing may consist of any combination of multi-band compression, noise suppression and noise reduction algorithms. The digitally processed signal is then converted back to analog signal with a digital to analog converter. The analog signal is shaped and amplified and sent to the coil 964, which generates a modulated electromagnetic field containing audio information representative of the audio signal and, along with the core 962, directs the electromagnetic field toward the magnet of the transducer EL. The magnet of transducer EL vibrates in response to the electromagnetic field, thereby vibrating the middle-ear acoustic member to which it is coupled, for example the tympanic membrane, or, for example the malleus 18 in FIGS. 3A and 3B of U.S. 2006/0023908, the full disclosure of which has been previously incorporated herein by reference.

In many embodiments, face plate 980 also has an acoustic opening 970 to allow ambient sound to enter the open chamber 986 of the shell. This allows ambient sound to travel through the open volume 986 along the internal compartment of the transmitter assembly and through one or more openings 968 at the distal end of the shell 966. Thus, ambient sound waves may reach and vibrate the eardrum and separately impart vibration on the eardrum. This open-channel design provides a number of substantial benefits. First, the open channel minimizes the occlusive effect prevalent in many acoustic hearing systems from blocking the car canal. Second, the natural ambient sound entering the car canal allows the electromagnetically driven effective sound level output to be limited or cut off at a much lower level than with a design blocking the ear canal.

With the two microphone embodiments, for example the external microphone and canal microphone as described herein, acoustic hearing aids can realize at least some improvement in sound localization, because of the decrease in feedback with the two microphones, which can allow at least some sound localization. For example a first microphone to detect high frequencies can be positioned near the ear canal, for example outside the ear canal and within about 5 mm of the ear canal opening, to detect high frequency sound localization cues. A second microphone to detect low frequencies can be positioned away from the ear canal opening, for example at least about 10 mm, or even 20 mm, from the ear canal opening to detect low frequencies and minimize feedback from the acoustic speaker positioned in the ear canal.

In some embodiments, the BTE components can be placed in body 910, except for the external microphone, such that the body 910 comprises the wireless circuitry and sound processor, battery and other components. The external microphone may extend from the body 910 and/or faceplate 980 so as to minimize feedback, for example similar to pull line 984 and at least about 10 mm from faceplate 980 so as to minimize feedback.

FIG. 10A shows feedback pressure at the canal microphone and feedback pressure at the external microphone versus frequency for an output transducer configured to vibrate the eardrum and produce the sensation of sound. The output transducer can be directly coupled to an ear structure such as an ossicle of the middle ear or to another structure such as the eardrum, for example with the EARLENS™ transducer EL. The feedback pressure $P_{FB(Canal,\ EL)}$ for the canal microphone with the EARLENS™ transducer EL is shown from about 0.1 kHz (100 Hz) to about 10 kHz, and can extend to about 20 kHz at the upper limit of human hearing. The feedback pressure can be expressed as a ratio in dB of sound pressure at the canal microphone to sound pressure at the eardrum. The feedback pressure $P_{FB(External,\ EL)}$ is also shown for external microphone with transducer EL and can be expressed as a ratio of sound pressure at the external microphone to sound pressure at the eardrum. The feedback pressure at the canal microphone is greater than the feedback pressure at the external microphone. The feedback pressure is generated when a transducer, for example a magnet, supported on the eardrum is vibrated. Although feedback with this approach can be minimal, the direct vibration of the eardrum can generate at least some sound that is transmitted outward along the canal toward the canal microphone near the car canal opening. The canal microphone feedback pressure $P_{FB(Canal)}$ comprises a peak around 2-3 kHz and decreases above about 3 kHz. The peak around 2-3 kHz corresponds to resonance of the ear canal. Although another sub peak may exist between 5 and 10 kHz for the canal microphone feedback pressure $P_{FB(Canal)}$, this peak has much lower amplitude than the global peak at 2-3 kHz. As the external microphone is farther from the eardrum than the canal microphone, the feedback pressure $P_{FB(External)}$ for the external microphone is lower than the feedback pressure $P_{FB(Canal)}$ for the canal microphone. The external microphone feedback pressure may also comprise a peak around 2-3 kHz that corresponds to resonance of the ear canal and is much lower in amplitude than the feedback pressure of the canal microphone as the external microphone is farther from the ear canal. As the high frequency localization cues can be encoded in sound frequencies above about 3 kHz, the gain of canal microphone and external microphone can be configured to detect high frequency localization cues and minimize feedback.

The canal microphone and external microphone may be used with many known transducers to provide at least some high frequency localization cues with an open ear canal, for example surgically implanted output transducers and hearing aides with acoustic speakers. For example, the canal microphone feedback pressure $P_{FB(Canal,\ Acoustic)}$ when an acoustic speaker transducer placed near the eardrum shows a resonance similar to transducer EL and has a peak near 2-3 kHz. The external microphone feedback pressure $P_{FB(External,\ Acoustic)}$ is lower than the canal microphone feedback pressure $P_{FB(Canal,\ Acoustic)}$ at all frequencies, such that the external microphone can be used to detect sound comprising frequencies at or below the resonance frequencies of the ear, and the canal microphone may be used to detect high frequency localization cues at frequencies above the resonance frequencies of the ear canal. Although the canal microphone feedback pressure $P_{FB(Canal,\ Acoustic)}$ is greater for the acoustic speaker output transducer than the canal microphone feedback pressure $P_{FB(Canal,\ EL)}$ for the EARLENS™ transducer EL, the acoustic speaker may deliver at least some high frequency sound localization cues when the external microphone is used to amply frequencies at or below the resonance frequencies of the ear canal.

FIG. 10B shows gain versus frequency at the output transducer for sound input to canal microphone and sound input to the external microphone to detect high frequency localization cues and minimize feedback. As noted above, the high frequency localization cues of sound can be encoded in frequencies above about 3 kHz. These spatial localization cues can include at least one of head shadowing or diffraction of sound by the pinna of the ear. Hearing system 10 may comprise a binaural hearing system with a first device in a first ear canal and a second device in a second ear contralateral ear canal of a second contralateral ear, in which the second device is similar to the first device. To detect head shadowing a microphone can be positioned such that the head of the user casts an acoustic shadow on the input microphone, for example with the microphone placed on a first side of the user's head opposite a second side of the users head such that the second side faces the sound source. To detect high frequency localization cues from sound diffraction of the pinna of the user, the input microphone can be positioned in the ear canal and also external of the ear canal and within about 5 mm of the entrance of the ear canal, or therebetween, such that the pinna of the ear diffracts sound waves incident on the microphone. This placement of the microphone can provide high frequency localization cues, and can also provide head shadowing of the microphone. The pinna diffraction cues that provide high frequency localization of sound can be present with monaural hearing. The gain for sound input to the external microphone for low frequencies below about 3 kHz is greater than the gain for the canal microphone. This can result in decreased feedback as the canal microphone has decreased gain as compared to the external microphone. The gain for sound input to the canal microphone for high frequencies above about 3 kHz is greater than the gain for the external microphone, such that the user can detect high frequency localization cues above 3 kHz, for example above 4 kHz, when the feedback is minimized.

The gain profiles comprise an input sound to the microphone and an output sound from the output transducer to the user, such that the gain profiles for each of the canal microphone and external microphone can be achieved in many ways with many configurations of at least one of the microphone, the circuitry and the transducer. The gain profile for sound input to the external microphone may comprise low pass components configured with at least one of a low pass microphone, low pass circuitry, or a low pass transducer. The gain profile for sound input to the canal microphone may comprise low pass components configured with at least one of a high pass microphone, high pass circuitry, or a high pass transducer. The circuitry may comprise the sound processor comprising a tangible medium configured to high pass filter the sound input from the canal microphone and low pass filter the sound input from the external microphone.

FIG. 10C shows a canal microphone with high pass filter circuitry and an external microphone with low pass filter circuitry, both coupled to a transducer to provide gain in response to frequency as in FIG. 10B. Canal microphone CM is coupled to high pass filer circuitry HPF. The high pass filter circuitry may comprise known low pass filters and is coupled to a gain block, GAIN2, which may comprise at least one of an amplifier AMP1 or a known sound processor configured to process the output of the high pass filter. External microphone EM is coupled to low pass filer circuitry LPF. The low pass filter circuitry comprise may comprise known low pass filters and is coupled to a gain block, GAIN2, which may comprise at least one of an amplifier AMP2 or a known sound processor configured to process the output of the high pass filter. The output can be combined at the transducer, and the transducer configured to vibrate the eardrum, for example directly. In some embodiments, the output of the canal microphone and output of the external microphone can be input separately to one sound processor and combined, which sound processor may then comprise a an output adapted for the transducer.

FIG. 10D1 shows a canal microphone coupled to first transducer TRANSDUCER1 and an external microphone coupled to a second transducer TRANSDUCER2 to provide gain in response to frequency as in FIG. 10B. The first transducer may comprise output characteristics with a high frequency peak, for example around 8-10 kHz, such that high frequencies are passed with greater energy. The second transducer may comprise a low frequency peak, for example around 1 kHz, such that low frequencies are passed with greater energy. The input of the first transducer may be coupled to output of a first sound processor and a first amplifier as described above. The input of the second transducer may be coupled to output of a second sound processor and a second amplifier. Further improvement in the output profile for the canal microphone can be obtained with a high pass filter coupled to the canal microphone. A low pass filter can also be coupled to the external microphone. In some embodiments, the output of the canal microphone and output of the external microphone can be input separately to one sound processor and combined, which sound processor may then comprise a separate output adapted for each transducer.

FIG. 10D2 shows the canal microphone coupled to a first transducer comprising a first coil wrapped around a core, and the external microphone coupled to a second transducer comprising second a coil wrapped around the core, as in FIG. 10D1. A first coil COIL1 is wrapped around the core and comprises a first number of turns. A second coil COIL2 is wrapped around the core and comprises a second number of turns. The number of turns for each coil can be optimized to produce a first output peak for the first transducer and a second output peak for the second transducer, with the second output peak at a frequency below the a frequency of the first output peak. Although coils are shown, many transducers can be used such as piezoelectric and photostrictive materials, for example as described above. The first transducer may comprise at least a portion of the second transducer, such that first transducer at least partially overlaps with the second transducer, for example with a common magnet supported on the eardrum.

The first input transducer, liar example the canal microphone, and second input transducer, for example the external microphone, can be arranged in many ways to detect sound localization cues and minimize feedback. These arrangements can be obtained with at least one of a first input transducer gain, a second input transducer gain, high pass filter circuitry for the first input transducer, low pass filter circuitry for the second input transducer, sound processor digital filters or output characteristics of the at least one output transducer.

The canal microphone may comprise a first input transducer coupled to at least one output transducer to vibrate an eardrum of the ear in response to high frequency sound localization cues above the resonance frequencies of the ear canal, for example resonance frequencies from about 2 kHz to about 3 kHz. The external microphone may comprise a second input transducer coupled to at least one output transducer to vibrate the eardrum in response sound frequencies at or below the resonance frequency of the ear canal. The resonance frequency of the ear canal may comprise frequencies within a range from about 2 to 3 kHz, as noted above.

The first input transducer can be coupled to at least one output transducer to vibrate the eardrum with a first gain for first sound frequencies corresponding to the resonance frequencies of the ear canal. The second input transducer can be coupled to the at least one output transducer to vibrate the eardrum with a second gain for the sound frequencies corresponding to the resonance frequencies of the ear canal, in which the first gain is less than the second gain to minimize feedback.

The first input transducer can be coupled to the at least one output transducer to vibrate the eardrum with a resonance gain for first sound frequencies corresponding to the resonance frequencies of the ear canal and a cue gain for sound localization cue comprising frequencies above the resonance frequencies of the ear canal. The cue gain can be greater than the resonance gain to minimize feedback and allow the user to perceive the sound localization cues.

FIG. 11A shows an elongate support 1110 comprising a plurality of optical fibers 1110P configured to transmit light and receive light to measure displacement of the eardrum. The plurality of optical fibers 1110P comprises at least a first optical fiber 1110A and a second optical fiber 1110B. First optical fiber 1110A is configured to transmit light from a source. Light circuitry comprises the light source and can be configured to emit light energy such that the user perceives sound. The optical transducer assembly OTA can be configured for placement on an outer surface of the eardrum, as described above.

The displacement of the eardrum and optical transducer assembly can be measured with second input transducer which comprises at least one of an optical vibrometer, a laser vibrometer, a laser Doppler vibrometer, or an interferometer configured to generate a signal in response to vibration of the eardrum. A portion of the transmitted light $\lambda_T$ can be reflected from at the eardrum and the optical transducer assembly OTA and comprises reflected light $\lambda_R$. The reflected light enters second optical fiber 1110B and is received by an optical detector coupled to a distal end of the second optical fiber 1110B, for example a laser vibrometer detector coupled to detector circuitry to measure vibration of the eardrum. The plurality of optical fibers may comprise a third optical fiber for transmission of light from a laser of the laser vibrometer toward the eardrum. For example, a laser source comprising laser circuitry can be coupled to the proximal end of the support to transmit light toward the ear to measure eardrum displacement. The optical transducer assembly may comprise a reflective surface to reflect light from the laser used for the laser vibrometer, and the optical wavelengths to induce vibration of the eardrum can be separate from the optical wavelengths used to measure vibration of the eardrum. The optical detection of vibration of the eardrum can be used for near-end speech measurement, similar to the piezo electric transducer described above. The optical detection of vibration of the eardrum can be used for noise cancellation, such that vibration of the eardrum is minimized in response to the optical signal reflected from at least one of eardrum or the optical transducer assembly.

Elongate support 1110 and at least one positioner, for example at least one of positioner 1130 or positioner 1140, or both, can be configured to position support 1110 in the ear canal with the electromagnetic energy transducer positioned outside the ear canal, and the microphone positioned at least one of in the ear canal or near the ear canal opening so as to detect high frequency spatial localization clues, as described above. For example, the output energy transducer, or emitter, may comprise a light source configured to emit electromagnetic energy comprising optical frequencies, and the light source can be positioned outside the ear canal, for example in a BTE unit. The light source may comprise at least one of an LED or a laser diode, for example. The light source, also referred to as an emitter, can emit visible light, or infrared light, or a combination thereof. The light source can be coupled to the distal end of the support with a waveguide, such as an optical fiber with a distal end of the optical fiber 1110D comprising a distal end of the support. The optical energy delivery transducer can be coupled to the proximal portion of the elongate support to transmit optical energy to the distal end. The positioner can be adapted to position the distal end of the support near an eardrum when the proximal portion is placed at a location near an ear canal opening. The intermediate portion of elongate support 1110 can be sized to minimize contact with a canal of the ear between the proximal portion to the distal end.

The at least one positioner, for example positioner 1130, can improve optical coupling between the light source and a device positioned on the eardrum, so as to increase 10 the efficiency of light energy transfer from the output energy transducer, or emitter, to an optical device positioned on the eardrum. For example, by improving alignment of the distal end 1110D of the support that emits light and a transducer positioned at least one of on the eardrum or in the middle ear. The at least one positioner and elongate support 1110 comprising an optical fiber can be combined with many known optical transducer and 15 hearing devices, for example as described in U.S. application Ser. No. 11/248,459, entitled "Systems and Methods for Photo-Mechanical Hearing Transduction", the full disclosure of which has been previously incorporated herein by reference, and U.S. Pat. No. 7,289,639, entitled "Hearing Implant", the full disclosure of which is incorporated herein by reference. The positioner and elongate support may also be combined with photo-electro-mechanical 20 transducers positioned on the ear drum with a support, as described in U.S. Pat. Ser. Nos. 61/073,271; and 61/073,281, both filed on Jun. 17, 2008, the full disclosures of which have been previously incorporated herein by reference.

In specific embodiments, elongate support 1110 may comprise an optical fiber coupled to positioner 1130 to align the distal end of the optical fiber with an output transducer assembly supported on the eardrum. The output transducer assembly may comprise a photodiode configured to receive light transmitted from the distal end of support 1110 and supported with support component 30 placed on the eardrum, as described above. The output transducer assembly can be separated from the distal end of the optical fiber, and the proximal end of the optical fiber can be positioned in the BTE unit and coupled to the light source. The output transducer assembly can be similar to the output transducer assembly described in U.S. 2006/0189841, with positioner 1130 used to align the optical fiber with the output transducer assembly, and the BTE unit may comprise a housing with the light source positioned therein.

FIG. 11B shows a positioner for use with an elongate support as in FIG. 11 A and adapted for placement near the opening to the ear canal. Positioner 1140 includes flanges 1142 that extend radially outward to engage the skin of the ear canal. Flanges 1142 are formed front a flexible material. Openings 1144 are defined by flanges 1142. Openings 1144 permit sound waves to pass positioner 1140 while the positioner is positioned in the ear canal, so that the sound waves are transmitted to the tympanic membrane. Although flanges 1142 define an outer boundary of support 1140 with an elliptical shape, flanges 1142 can comprise an outer boundary with any shape, for example circular. In some embodiments, the positioner has an outer boundary defined by the shape of the individual user's ear canal, for example embodiments where positioner 1140 is made from a mold of the user's ear. Elongate support 1110 extends transversely through positioner 1140.

FIG. 11C shows a positioner adapted for placement near a distal end of the elongate support as in FIG. 11A. Positioner 1130 includes flanges 1132 that extend radially outward to engage the skin of the ear canal. Flanges 1132 are formed from a flexible material. Openings 1134 are defined by flanges 1132. Openings 1134 permit sound waves to pass positioner 1130 while the positioner is positioned in the ear canal, so that the sound waves are transmitted to the tympanic membrane. Although flanges 1132 define an outer boundary of support 1130 with an elliptical shape, flanges 1132 can comprise an outer boundary with any shape, for example circular. In some embodiments, the positioner has an outer boundary defined by the shape of the individual user's ear canal, for example embodiments where positioner 1130 is made from a mold of the user's ear. Elongate support 1110 extends transversely through positioner 1130.

Although an electromagnetic transducer comprising coil 1119 is shown positioned on the end of elongate support 1110, the positioner and elongate support can be used with many types of transducers positioned at many locations, for example optical electromagnetic transducers positioned outside the ear canal and coupled to the support to deliver optical energy along the support, for example through at least one optical fiber. The at least one optical fiber may comprise a single optical fiber or a plurality of two or more optical fibers of the support. The plurality of optical fibers may comprise a parallel configuration of optical fibers configured to transmit at least two channels in parallel along the support toward the eardrum of the user.

While the exemplary embodiments have been described above in some detail for clarity of understanding and by way of example, a variety of additional modifications, adaptations, and changes may be clear to those of skill in the art. Hence, the scope of the present invention is limited solely by the appended claims.

What is claimed is:

1. An audio listening system for use with an ear of a user, the system comprising:

an external microphone configured for placement external to the ear canal to measure external sound pressure;

a transducer configured for placement inside the ear canal on an eardrum of the user to vibrate the eardrum and transmit sound to the user in response to the external microphone, wherein the transducer comprises an output transducer, the output transducer comprising a photodetector connected to a coil, the output transducer being configured to vibrate the eardrum;

a sound processor configured with active noise cancellation to cause the transducer to adjust vibration of the eardrum to minimize or cancel an external sound perceived by the user based on the external sound pressure measured by the external microphone; and a light source coupled to an output of the sound processor and configured to emit a light signal to the transducer to vibrate the transducer when the transducer is positioned on the eardrum of the user, wherein the light signal comprises a combination of the external sound perceived by the user based on the external sound pressure measured by the external microphone and a direct audio signal.

2. The system of claim 1 wherein the transducer is configured for placement on the eardrum to vibrate the eardrum in response to a wide bandwidth signal comprising frequencies from about 0.1 kHz to about 10 kHz.

3. The system of claim 2 wherein the sound processor is configured to minimize feedback from the transducer.

4. The system of claim 3 wherein the sound processor is configured to determine a feedback transfer function in response to the external sound pressure.

5. The system of claim 1 further comprising an external input for listening.

6. The system of claim 5 wherein the external input comprises an analog input configured to receive an analog audio signal from an external device.

7. The system of claim 1 wherein wireless communication circuitry is coupled to the transducer and configured to vibrate the transducer in response to far-end speech.

8. The system of claim 7 wherein the sound processor is coupled to the wireless communication circuitry and to process the far-end speech to generate processed far-end speech and wherein the processor is configured to vibrate the transducer in response to the processed far-end speech.

9. The system of claim 8 wherein wireless communication circuitry is configured to receive far-end speech from a communication channel of a mobile phone.

* * * * *